US012698782B2

(12) United States Patent
Li

(10) Patent No.: US 12,698,782 B2
(45) Date of Patent: Aug. 4, 2026

(54) AIR PUMP DEVICE WITH AUTOMATIC AIR REPLENISHING FUNCTION AND METHOD OF USING SAME

(71) Applicant: WangLi Plastic & Electronics (Huizhou) Co., Ltd., Huizhou (CN)

(72) Inventor: Yonghe Li, Huizhou (CN)

(73) Assignee: WangLi Plastic & Electronics (Huizhou) Co., Ltd., Huizhou (CN)

( * ) Notice: Subject to any disclaimer, the term of this patent is extended or adjusted under 35 U.S.C. 154(b) by 0 days.

(21) Appl. No.: 19/006,444

(22) Filed: Dec. 31, 2024

(65) Prior Publication Data

US 2026/0110307 A1 Apr. 23, 2026

(30) Foreign Application Priority Data

Oct. 22, 2024 (CN) ..... 202411477750.8

(51) Int. Cl.
*F04D 27/00* (2006.01)
*F04D 17/16* (2006.01)

(52) U.S. Cl.
CPC ..... *F04D 27/008* (2013.01); *F04D 27/001* (2013.01); *F04D 17/16* (2013.01)

(58) Field of Classification Search
CPC ..... F04D 27/008; F04D 27/001; F04D 17/16
See application file for complete search history.

(56) References Cited

U.S. PATENT DOCUMENTS

| | | | | |
|---|---|---|---|---|
| 12,116,989 | B2 * | 10/2024 | Qin | F04D 25/084 |
| 2015/0164236 | A1 * | 6/2015 | Driscoll, Jr. | A47C 27/083 5/713 |
| 2021/0127849 | A1 * | 5/2021 | Li | A47C 27/10 |
| 2022/0349415 | A1 * | 11/2022 | Huang | F04D 25/084 |

FOREIGN PATENT DOCUMENTS

| | | | | |
|---|---|---|---|---|
| CN | 106194794 | A * | 12/2016 | F04D 29/664 |
| CN | 107035703 | A * | 8/2017 | F04D 29/403 |
| CN | 105179214 | B * | 10/2017 | |
| CN | 212454758 | U * | 2/2021 | F04D 25/084 |
| CN | 223387495 | U * | 9/2025 | |

* cited by examiner

*Primary Examiner* — Brian Christopher Delrue
(74) *Attorney, Agent, or Firm* — MUNCY, GEISSLER, OLDS & LOWE, P.C.

(57) ABSTRACT

An air pump device with an automatic air replenishing function includes: a mounting housing, provided with an external air vent and a valve port; an air duct, both ends of which are respectively communicated with the external air vent and the valve port; a blower, provided within the mounting housing and configured to drive air within the air duct to flow; a control system, provided within the mounting housing and configured to control various electrical parts within the air pump device; and further includes: an air replenishing pump, provided within the mounting housing; an air pressure sensor, configured to collect air pressure data for the control system. The control system monitors an internal air pressure of the inflatable product and triggers, when monitored air pressure is lower than a preset threshold, the air replenishing pump to output air for entering the inner cavity of the inflatable product.

15 Claims, 25 Drawing Sheets

AIR PUMP DEVICE WITH AUTOMATIC AIR REPLENISHING FUNCTION AND METHOD OF USING SAME

CROSS REFERENCE TO RELATED APPLICATIONS

The present application claims priority from Chinese Application No. CN 202411477750.8 filed on Oct. 22, 2024, all of which are hereby incorporated herein by reference.

TECHNICAL FIELD

The present disclosure relates to the technical field of air pumps for inflatable products, and in particular to an air pump device with an automatic air replenishing function and a method of using the same.

BACKGROUND

Currently, the air pump in the prior art is often provided along with an inflatable product, and mounted within the inflatable product, to enable automatic inflation of the inflatable product. Some large inflatable products have fixed thereon an inflatable air pump, and the inflatable air pump is provided with an air inlet. During the inflation, the air inlet is opened to allow the inflatable air pump to inflate air into the inner cavity of the inflatable product. After the inflation is completed, the air inlet is closed to prevent the air within the inflatable product from leaking out. When needing to deflate the inflatable product, a deflation function of the air pump may be started to automatically exhaust the air inside the inflatable product.

However, there are still some shortcomings in the current air pump device in practical application. For example, after completing the inflation of the inflatable product, the air pump device will be in a turned off state, whereas after the inflatable product is subjected to a certain degree of pressing or used for a period of time, the air inside the inflatable product tends to leak gradually, and the air pressure will not stay stable for a long time. Only after the inflatable product is obviously deflated due to excessive air leakage and is discovered by the user, will the user consciously restart the air pump device to replenish the inflatable product with air, to restore the inflatable product to an inflated state with appropriate hardness, thus leading to inconvenience in use.

SUMMARY

In order to solve the problems existing in the prior art, the present disclosure provides an air pump device with an automatic air replenishing function and a method of using the same, which can enable the air pump device to automatically discover excessive changes in the air pressure of the inflatable product, and to adjust the air volume of the inflatable product in time, ensuring that the internal air pressure of the inflatable product is stable, thus leading to more flexibility and convenience in use.

An aspect of the present disclosure provides an air pump device with an automatic air replenishing function, including: a mounting housing, provided with an external air vent, conFIGured to be arranged outside an inflatable product and a valve port, conFIGured to be connected to an inner cavity of the inflatable product; an air duct, formed within the mounting housing and with both ends respectively communicated with the external air vent and the valve port; a blower, provided within the mounting housing and conFIGured to drive air within the air duct to flow; a control system, provided within the mounting housing and conFIGured to control various electrical parts within the air pump device; further including: an air replenishing pump, provided within the mounting housing and controlled by the control system; an air pressure sensor, conFIGured to collect air pressure data for the control system, where the control system monitors an internal air pressure of the inflatable product through the air pressure sensor, and triggers, when a monitored value of air pressure is lower than a preset threshold, the air replenishing pump to output air for entering the inner cavity of the inflatable product.

Another aspect of the present disclosure provides a method of using the above air pump device, which includes: when needing to inflate an inflatable product, controlling, by the control system, to open the valve port of the air pump device, and further controlling the blower to rotate and pump in the external air from the external air vent of the air pump device into the air duct of the air pump device, and driving the air within the air duct into the inflatable product through the valve port; and when the air pressure sensor of the air pump device detects that the air pressure of the inner cavity of the inflatable product rises to the preset threshold, controlling, by the control system, the blower to stop and controlling to close the valve port of the air pump device.

BRIEF DESCRIPTION OF DRAWINGS

In order to illustrate the technical solution of the present disclosure or the prior art more clearly, the accompanying drawings needed to be used in the description of the embodiments or the prior art will be briefly introduced below.

DETAILED DESCRIPTION

The embodiments of the present disclosure will be described below in detail, the examples of which are illustrated in the accompanying drawings.

Figure 1:
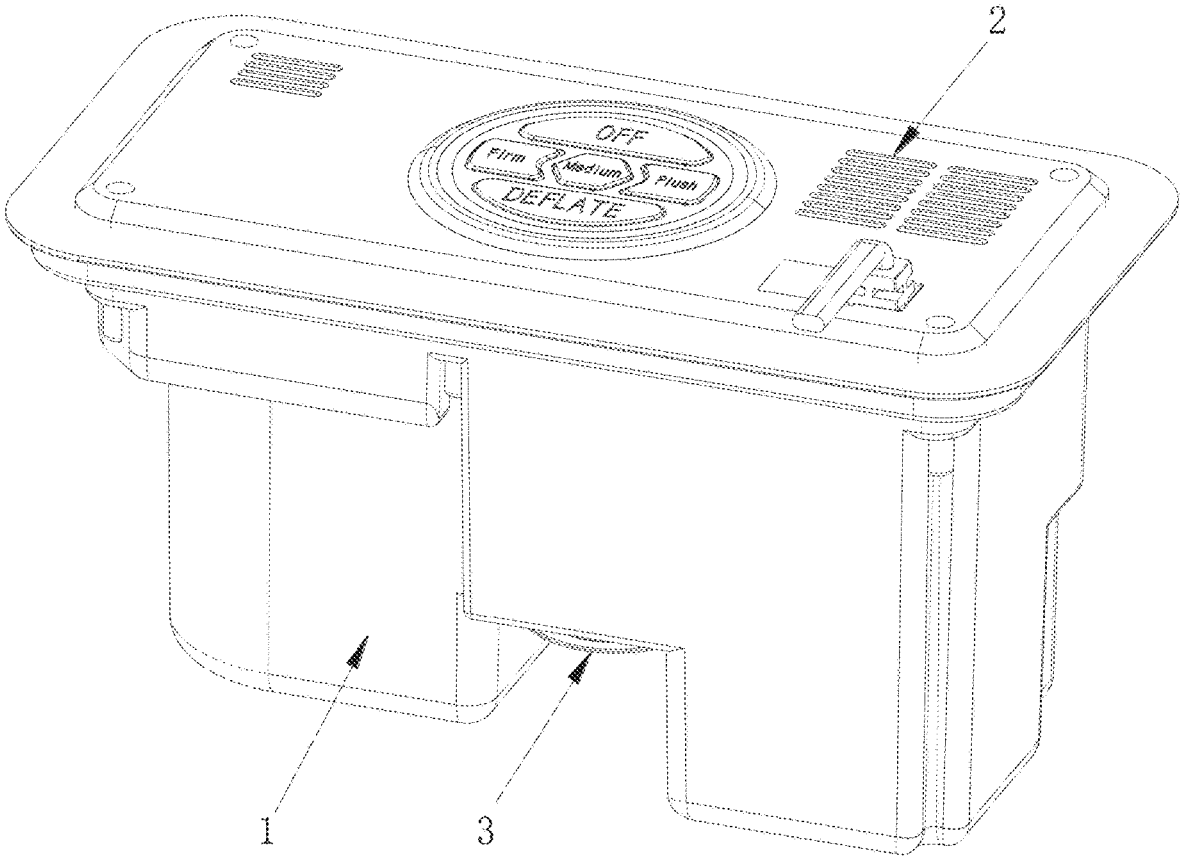
FIG. 1 is an external structural diagram of an air pump device according to an embodiment of the present disclosure.

FIG. 1 provides an air pump device with an automatic air replenishing function, including a mounting housing 1 provided with an external air vent 2 and a valve port 3. When the air pump device is mounted on an inflatable product, the mounting housing 1 is fixedly embedded into an inner cavity of the inflatable product. Moreover, the external air vent 2 is arranged outside the inflatable product to facilitate the entry of external air. The valve port 3 is located in the inner cavity of the inflatable product, such that the valve port 3 can be connected to the inner cavity of the inflatable product. The mounting housing 1 is formed inside with an air duct (not marked in the drawings), both ends of which are respectively communicated with the external air vent 2 and the valve port 3.

Figure 2:
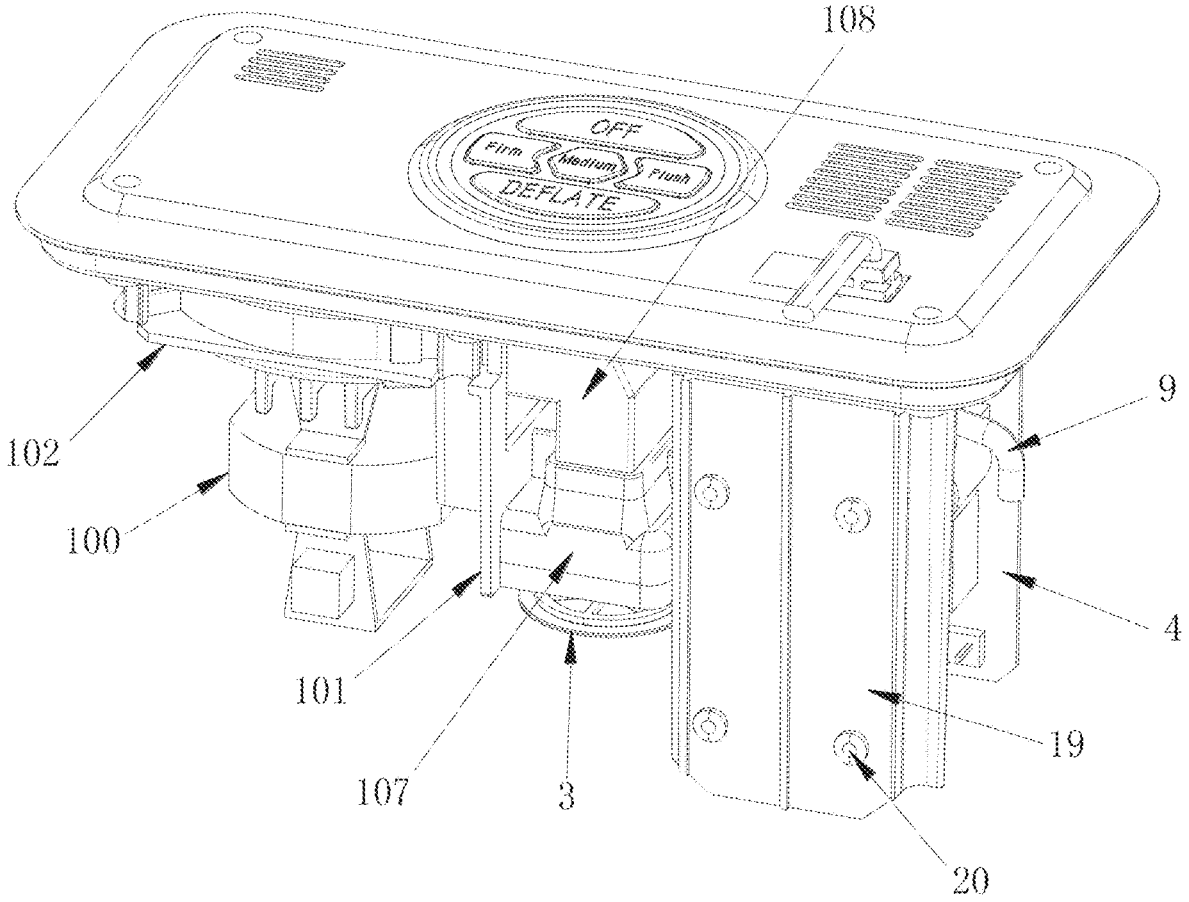
FIG. 2 is an internal structure diagram of FIG. 1.
Figure 3:
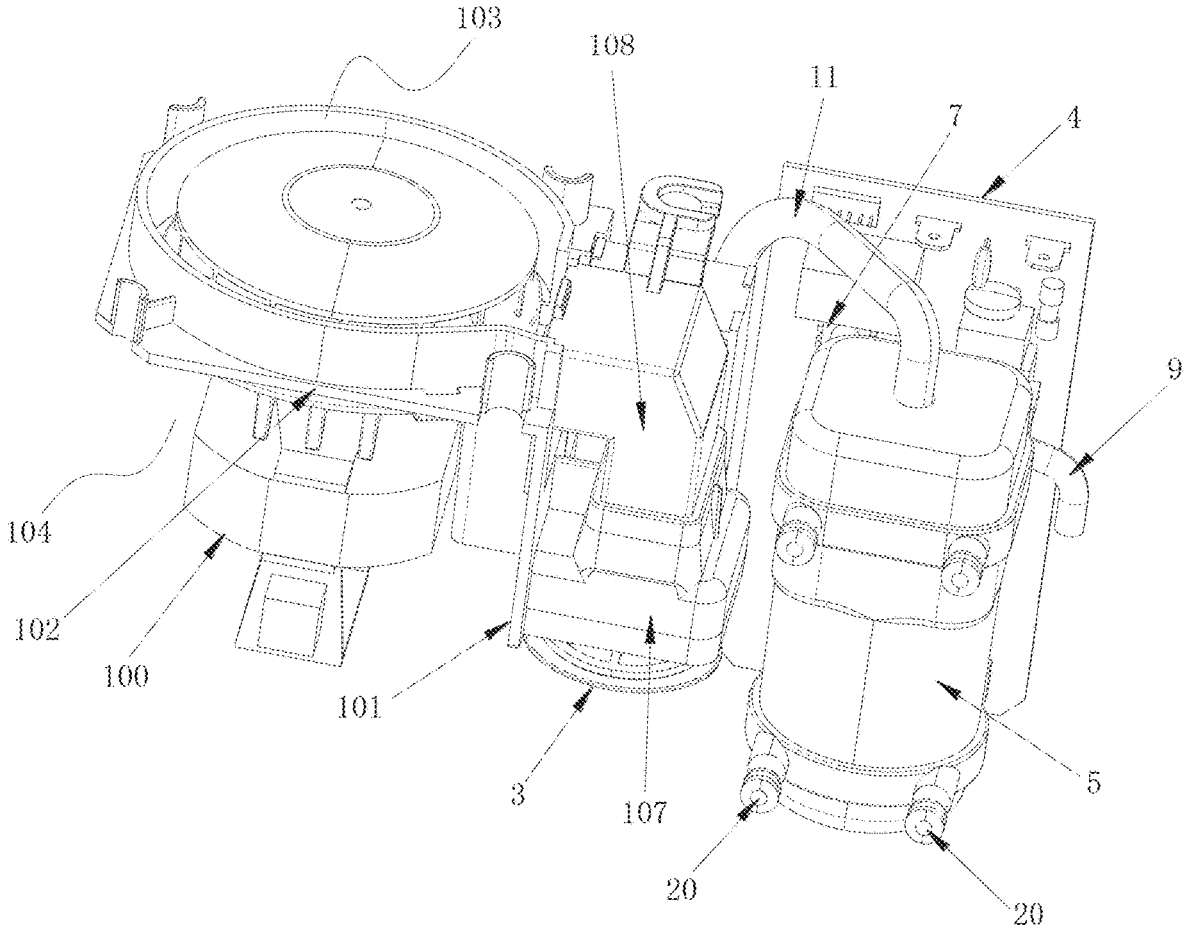
FIG. 3 is another internal structure diagram of FIG. 1.
Figure 4:
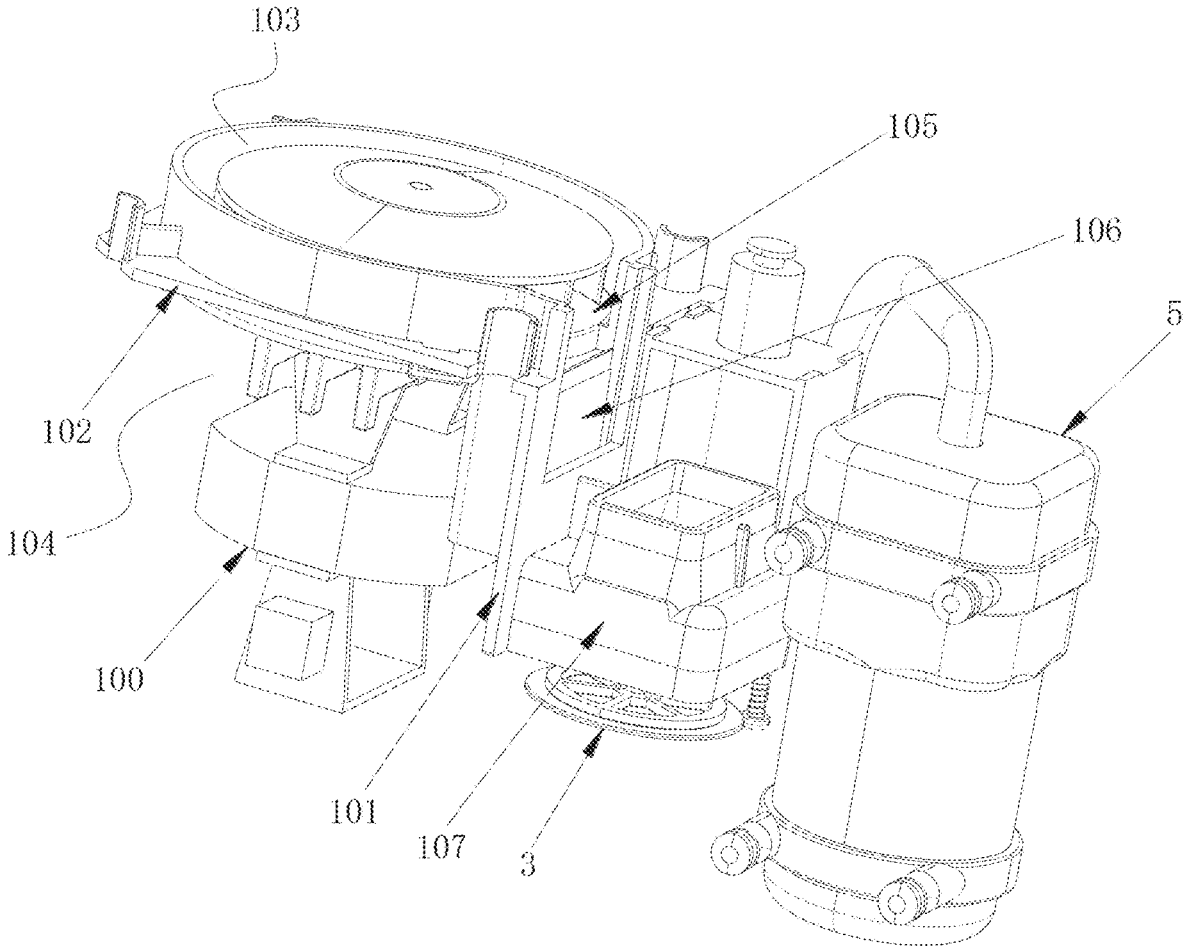
FIG. 4 is another internal structure diagram of FIG. 1, with an L-shaped switching pipe 108 hidden.

Referring to FIGS. 2-4, the mounting housing 1 is mounted inside with a blower 100, a control system 4, an air replenishing pump 5 and an air pressure sensor 7. The blower 100 is conFIGured to drive air within the above air duct to flow. The control system 4 is conFIGured to control various electrical parts within the air pump device. The startup of the air replenishing pump 5 is controlled by the control system 4. The air pressure sensor 7 is conFIGured to collect air pressure data for the control system 4. The control system 4 monitors an internal air pressure of the inflatable product through the air pressure sensor 7, and triggers, when a monitored value of air pressure is lower than a preset threshold, the air replenishing pump 5 to output air for entering the inner cavity of the inflatable product.

In addition to the blower 100 inside the mounting housing 1 for inflating and deflating the inflatable product, the air pump device according to the present disclosure is additionally provided with the air replenishing pump 5 and the air pressure sensor 7. The air pressure sensor 7 is conFIGured to detect and collect the air pressure data of the inner cavity of the inflatable product for the control system 4 of the air pump device. The control system 4 monitors the internal air pressure of the inflatable product through the air pressure sensor 7, and triggers, when the monitored value of air pressure is lower than the preset threshold, the air replenishing pump 5 to output air for entering the inner cavity of the inflatable product. Through this solution, the air pump device is enabled to automatically discover excessive air leakage in the inflatable product, to automatically discover excessive changes in the air pressure of the inflatable product, to replenish air to the inflatable product in time, and to adjust the air volume of the inflatable product, ensuring that the internal air pressure of the inflatable product is stable, thus leading to more flexibility and convenience in use.

The method of using the above air pump device is as follows.

A first usage scenario is described. When needing to inflate the inflatable product, the control system 4 controls to open the valve port 3 of the air pump device, and further controls the blower 100 to rotate and pump in the external air from the external air vent 2 of the air pump device into the air duct of the air pump device, and to drive the air within the air duct into the inflatable product through the valve port 3; and when the air pressure sensor 7 of the air pump device detects that the air pressure of the inner cavity of the inflatable product rises to the preset threshold, the control system 4 controls the blower 100 to stop and controls to close the valve port 3 of the air pump device. Through the using method in this scenario, the air pump device can quickly inflate the inflatable product, such that the inner cavity of the inflatable product is quickly filled with air, and in turn can be quickly expanded and put into normal use.

A second usage scenario is described. After the inflation is completed, the control system 4 continues to monitor the internal air pressure of the inflatable product through the air pressure sensor 7; when the value of air pressure monitored by the air pressure sensor 7 is lower than the preset threshold, the control system 4 starts the air replenishing pump 5 of the air pump device to replenish air to the inner cavity of the inflatable product; and when the air pressure sensor 7 detects that the air pressure of the inner cavity of the inflatable product rises to the preset threshold, the control system 4 controls the air replenishing pump 7 to stop operating. Through the using method in this scenario, the air pump device can automatically discover excessive air leakage in the inflatable product, and replenish air to the inflatable product in time, ensuring that the internal air pressure of the inflatable product is stable, thus leading to more flexibility and convenience in use.

A third use scenario is described. when needing to deflate the inflatable product, the control system 4 controls to open the valve port 3 of the air pump device, and further controls the blower 100 to rotate and continuously drives the air within the air duct of the air pump device to be exhausted to the outside through the external air vent 2, such that the air duct of the air pump device forms a negative pressure and pumps out the air of the inner cavity of the inflatable product through the valve port 3; and when the air pressure sensor 7 of the air pump device detects that the air pressure of the inner cavity of the inflatable product drops to the preset threshold, the control system 4 controls the blower 100 to stop and controls to close the valve port 3 of the air pump device. Through the using method in this scenario, the air pump device can quickly deflate the inflatable product, such that the air can be quickly pumped out from the inflated inner cavity of the inflatable product, and the inflatable product can be quickly switched to contracted state.

A fourth use scenario is described. When needing to adjust and reduce the air pressure of the inflatable product, the control system 4 controls to open the valve port 3, such that the air of the inner cavity of the inflatable product naturally enters the air duct of the air pump device and is exhausted to the outside through the external air vent 2; when the air pressure sensor 7 of the air pump device detects that the air pressure of the inner cavity of the inflatable product drops to the preset threshold, the control system 4 controls to close the valve port 3 of the air pump device; when the air pressure sensor 7 detects that the air pressure of the inner cavity of the inflatable product is lower than the preset threshold, the control system 4 starts the air replenishing pump 5 of the air pump device to replenish air to the inner cavity of the inflatable product; and when the air pressure sensor 7 of the air pump device detects that the air pressure of the inner cavity of the inflatable product rises to the preset threshold, the control system 4 controls the air replenishing pump 5 to stop operating. Through the using method in this scenario, the air pump device can easily adjust and reduce the air pressure of the inflatable product, preventing the inflatable product from affecting the user's use experience due to expansion to over hard state. Moreover, after the air pressure of the inflatable product is adjusted and reduced, if the air pressure is low due to inaccurate adjustment, the control system 4 of the air pump device can discover it in time through the air pressure sensor 7, and can replenish air to the inflatable product in time, ensuring that the internal air pressure of the inflatable product meets the requirements, thus leading to more flexibility and convenience in the pressure adjusting operation on the inflatable product by the air pump device.

Figure 5:
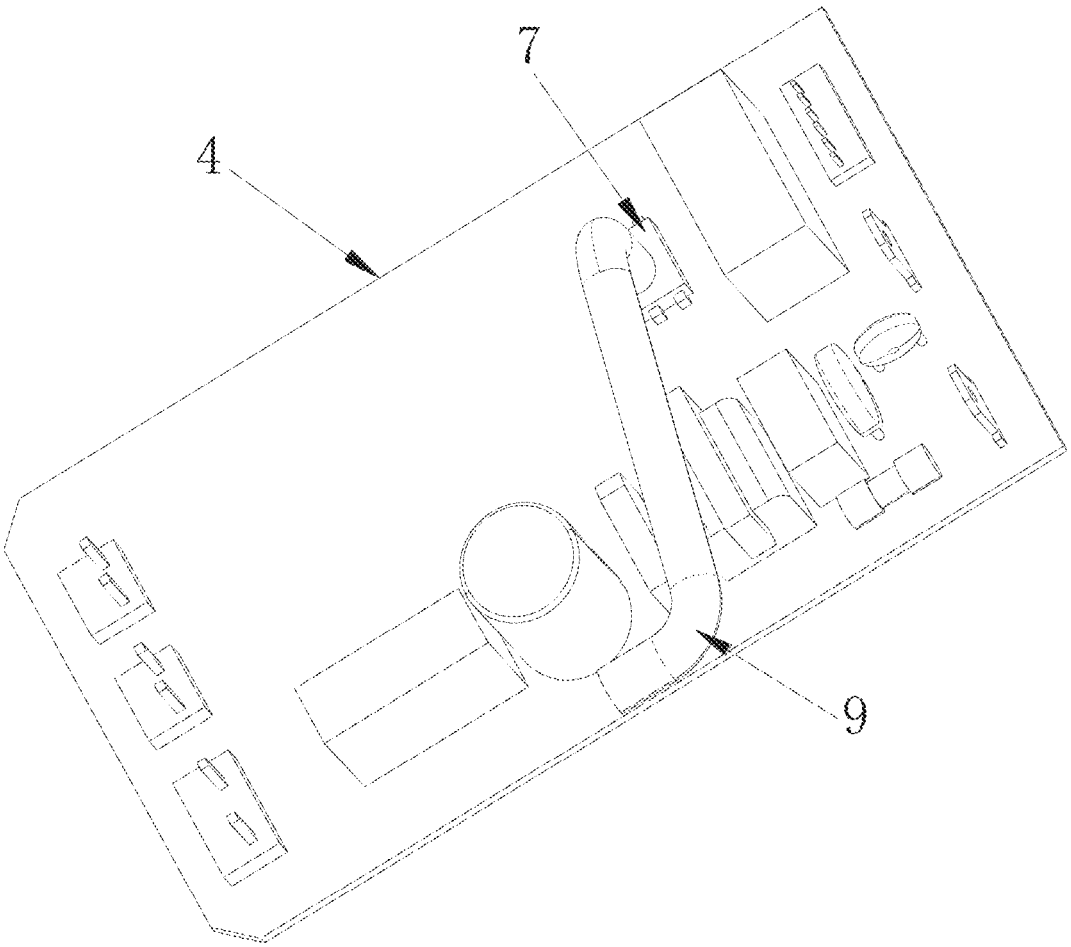
FIG. 5 is a structural diagram of a control system according to an embodiment of the present disclosure.
Figure 6:
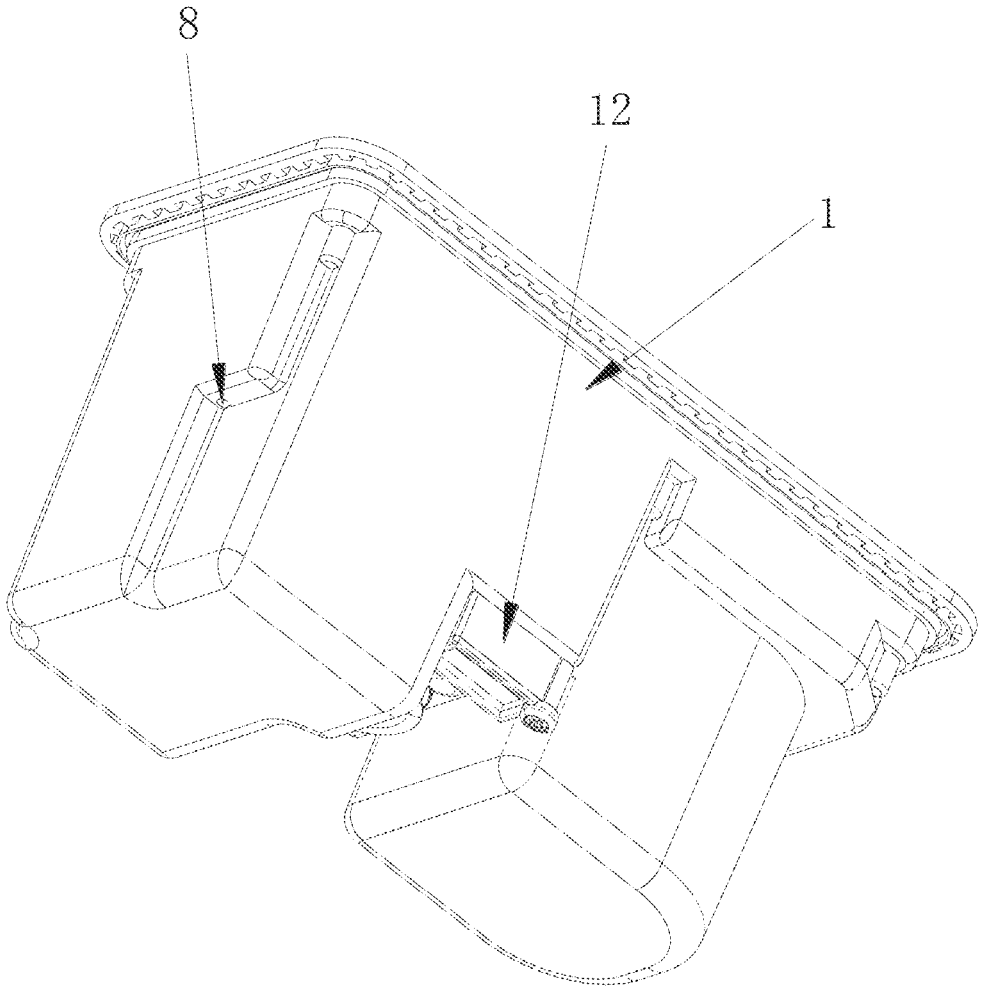
FIG. 6 is a structural diagram of a bottom of a mounting housing according to an embodiment of the present disclosure.

In an embodiment, specifically, in further conjunction with FIGS. 5 and 6, an outer wall of the mounting housing 1 is provided with a detection port 8, which is configured to be communicated with the inner cavity of the inflatable product. The mounting housing 1 is mounted inside with an air pressure collecting pipe 9, one end of which is hermetically butted with the detection port 8, and the other end of which is hermetically butted with a detection end of the air pressure sensor 7. The detection end of the air pressure sensor 7 is communicated with the inner cavity of the inflatable product through the air pressure collecting pipe 9. Therefore, through this structure, the air pressure sensor 7 inside the mounting housing 1 can smoothly monitor the internal air pressure of the inflatable product and collect the air pressure data.

Figure 7:
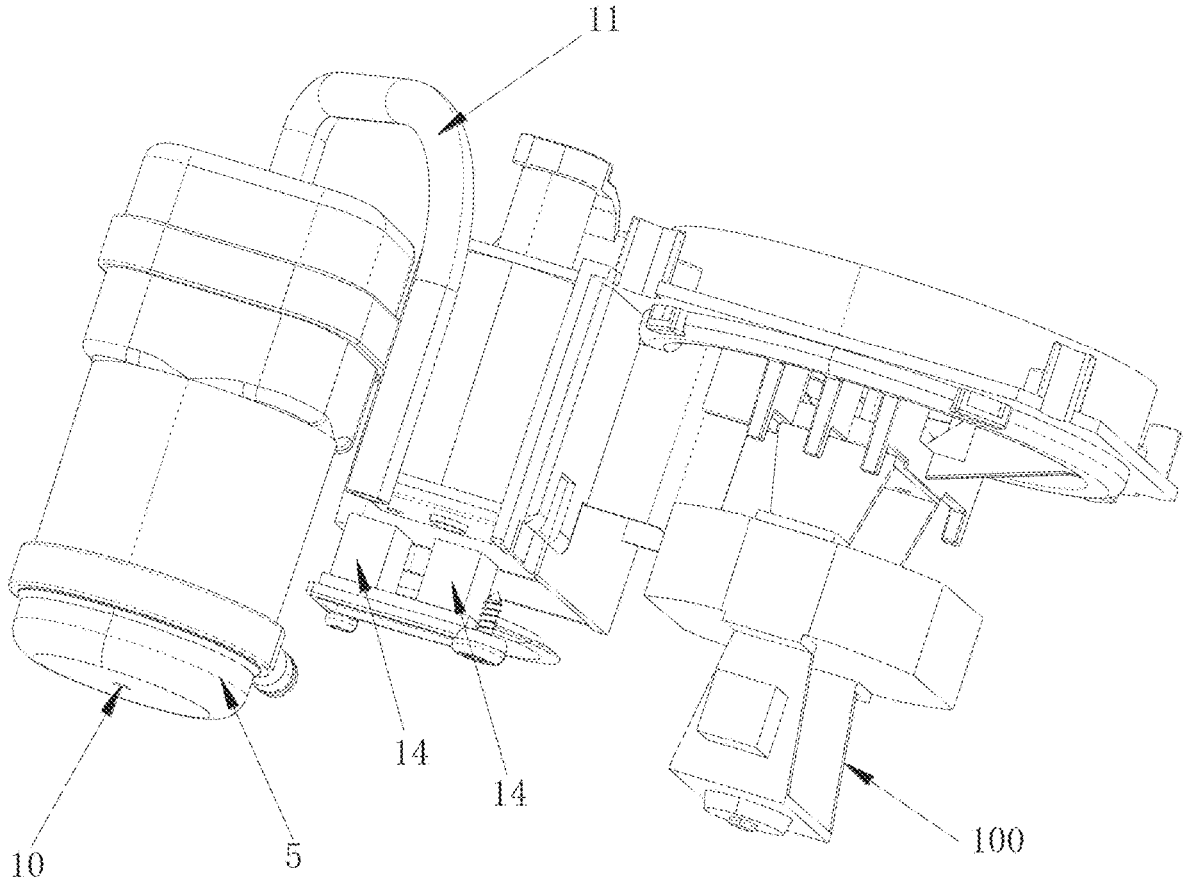
FIG. 7 is another internal structure diagram of FIG. 1.
Figure 8:
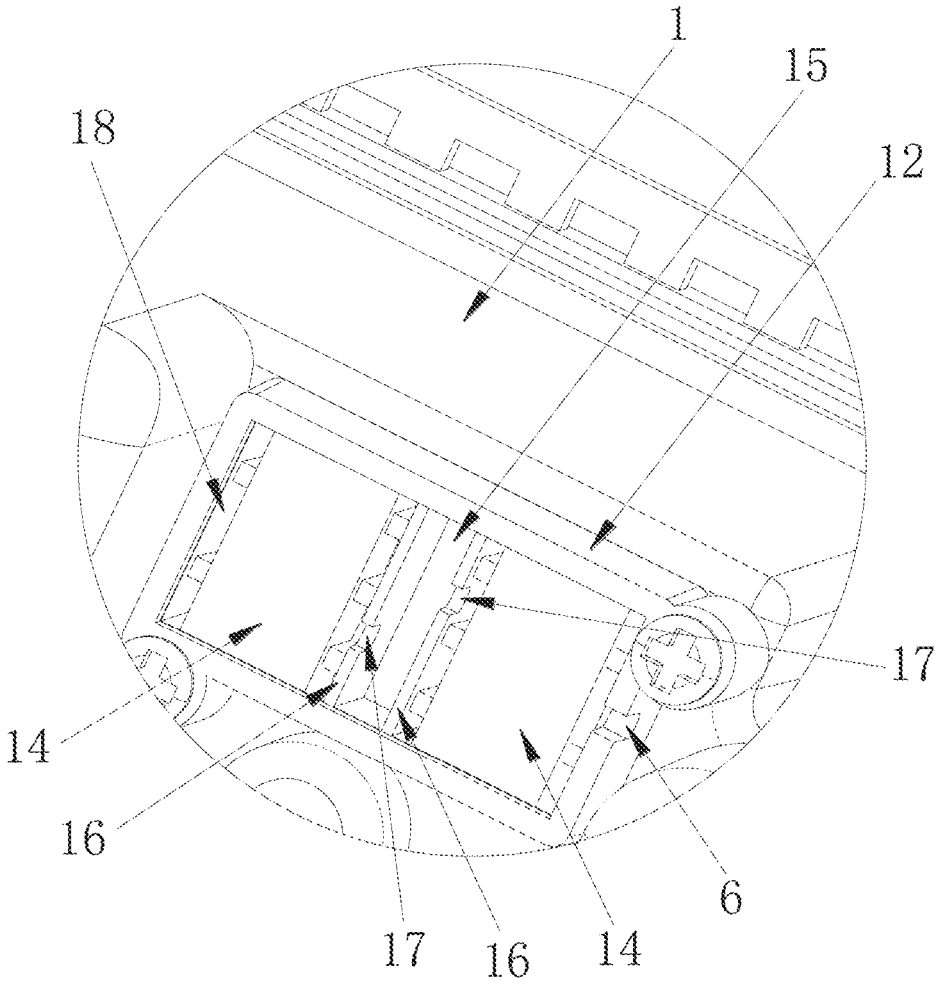
FIG. 8 is a partially enlarged view of an air replenishing box portion according to an embodiment of the present disclosure.
Figure 9:
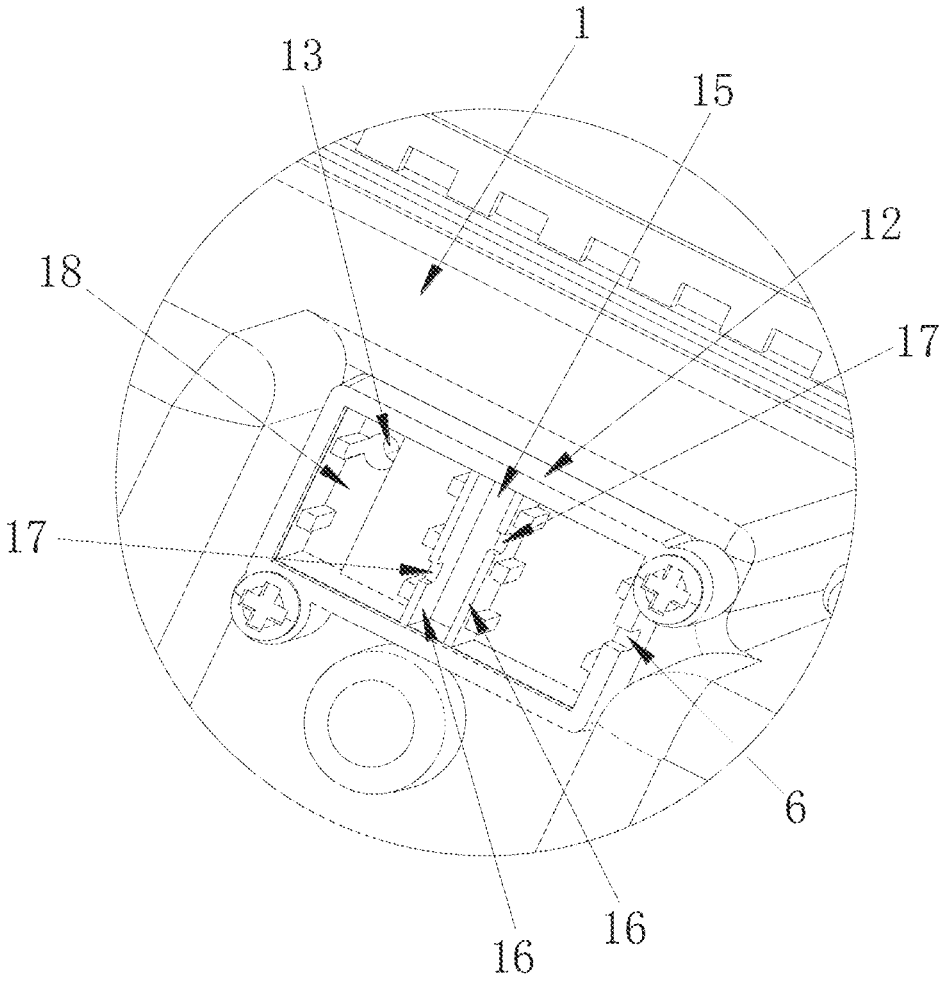
FIG. 9 is an enlarged view of an air replenishing box portion of FIG. 8, with silencing cotton chunks hidden.

As shown in FIG. 7, the air replenishing pump 5 is provided thereon with an outer air inhaling port 10 and an air ejector pipe 11, and the outer air inhaling port 10 is communicated with the air duct within the mounting housing 1, such that the air replenishing pump 5 can pump in air through the air duct within the mounting housing 1. Referring to FIGS. 6-9, an air replenishing box 12 is provided at the bottom of the mounting housing 1, both the left and right sides of the air replenishing box 12 are respectively provided with an air ejector pipe interface 13 and an air replenishing port 6, and the air ejector pipe interface 13 is hermetically butted with the air ejector pipe 11 of the air replenishing pump 5, such that the air replenishing pump 5 inputs air into the air replenishing box 12 through the air ejector pipe interface 13. Moreover, the air replenishing port 6 is configured to communicate the inner cavity of the inflatable product outwards, such that the air input into the air replenishing box 12 from the air replenishing pump 5 can smoothly enter the inflatable product through the air replenishing port 6, carrying out an air replenishing operation on the inflatable product. In addition, two silencing cotton chunks 14 sleeved inside the air replenishing box 12 are arranged between the air ejector pipe interface 13 and the air replenishing port 6. A transition cavity 15 formed inside the air replenishing box 12 is arranged between every two silencing cotton chunks 14. The transition cavity 15 is internally provided with two partition plates 16, each provided thereon with an intermediate channel 17. Two adjacent intermediate channels 17 are staggered form each other, ensuring that the two intermediate channels 17 will not directly correspond to each other. The air replenishing pump 5 inhales air through the outer air inhaling port 10, and the air replenishing pump 5 inputs an airflow into the air replenishing box 12 through the air ejector pipe 11 and the air ejector pipe interface 13, drives the airflow to sequentially pass through the silencing cotton chunks 14, and then outputs the airflow from the air replenishing port 6 to the inner cavity of the inflatable product.

Through this structure, the air replenishing pump 5 can smoothly pump in air from the outside from the air duct inside the air pump device, ensuring that the air replenishing pump 5 can operate normally. In addition, the air ejected by the air replenishing pump 5 first needs to enter the air replenishing box 12 and pass through each of the silencing cotton chunks 14 inside the air replenishing box 12 sequentially before finally entering the inflatable product. This structure can effectively reduce the noise generated by the airflow outputted from the air replenishing pump 5 in the process of leading to the interior of the inflatable product, which is helpful to make the air pump device quieter in the process of air replenishing. In addition, the air input from the air replenishing pump 5 into the air replenishing box 12 can also pass by the transition cavity 15 defined between two silencing cotton chunks 14 before reaching the inner cavity of the inflatable product. This structure is helpful to reduce the resistance encountered when the airflow passes through each of the silencing cotton chunks 14, such that the airflow outputted from the air replenishing pump 5 can be ensured to flow smoothly inside the air replenishing box 12 as far as possible while taking into account noise reduction, and the flow speed of the airflow inside the air replenishing box 12 can be prevented from being too slow as much as possible, ensuring that the air outputted from the air replenishing pump 5 can enter the inflatable product efficiently. It should also be noted that in the above structure, two adjacent intermediate channels 17 are staggered from each other at different positions to ensure that the two intermediate channels 17 do not directly correspond to each other. This structure can prevent the airflow from going straight out of the transition cavity 15, and can make the airflow more easily fill the whole transition cavity 15, such that the airflow can increase, within the transition cavity 15, the contact area with the silencing cotton chunks 14, and in turn the airflow can more fully pass through the silencing cotton chunks 14, achieving a better noise reduction effect.

Furthermore, an air collecting cavity 18 is formed between an inner side of the air replenishing box 12 and one silencing cotton chunk 14 on the left, the air collecting cavity 18 has a smaller space than the transition cavity 15, and the air ejector pipe interface 13 is connected into the air collecting cavity 18. It can be appreciated that by forming the air collecting cavity 18 inside the air replenishing box 12 and connecting the air ejector pipe interface 13 into the air collecting cavity 18, this structure can prevent the air outputted from the air replenishing pump 5 from entering the silencing cotton chunks 14 within the air replenishing box 12 first, and instead make the air outputted from the air replenishing pump 5 first enter and fill the air collecting cavity 18 within the air replenishing box 12, such that the airflow can increase, within the air collecting cavity 18, the contact area with the silencing cotton chunks 14, and in turn the airflow can more fully pass through the silencing cotton chunks 14, achieving a better noise reduction effect.

Returning to FIG. 2, one side of the air replenishing pump 5 is provided with a support plate 19 fixed within the mounting housing 1, and a plurality of damping blocks 20 are elastically connected between the support plate 19 and the air replenishing pump 5. Therefore, under the buffering effect of each of the damping blocks 20, the mechanical vibration generated when the air pump 5 is operating can be prevented from being directly transferred to the mounting housing 1 of the air pump device, optimizing the damping effect of the air pump device.

Figure 10:
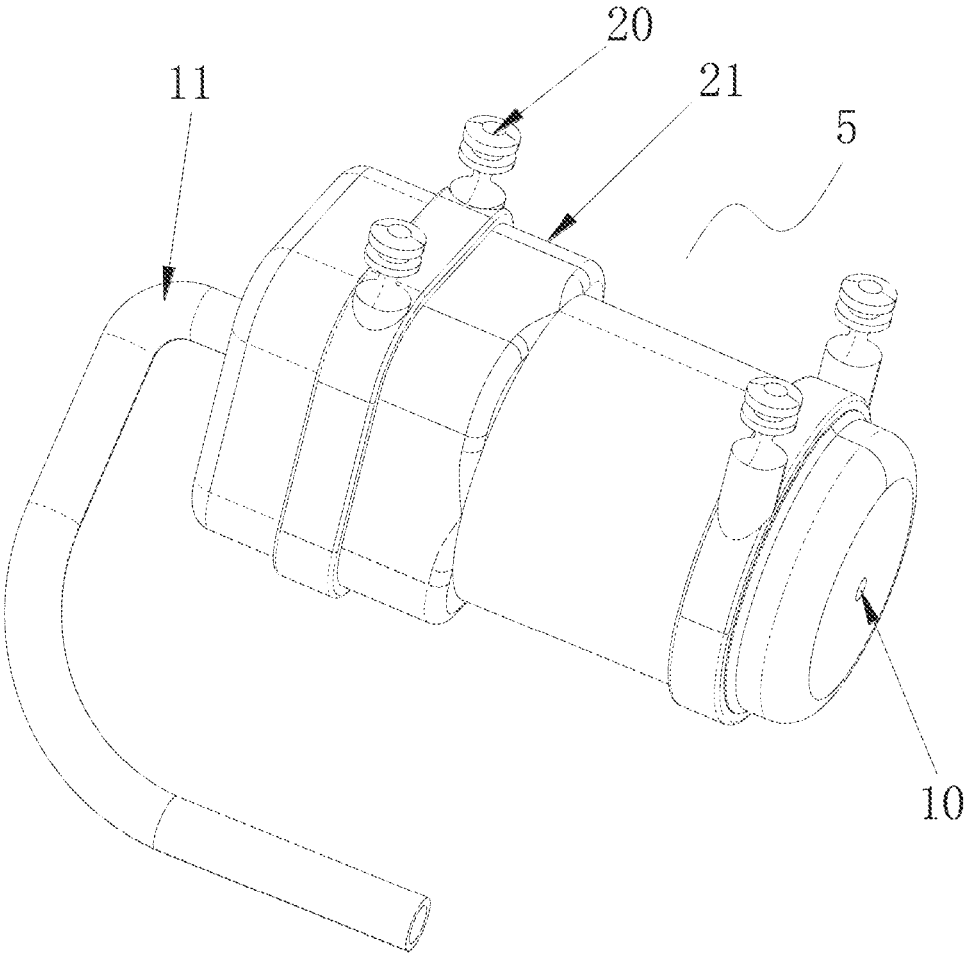
FIG. 10 is an overall structural diagram of an air replenishing pump according to an embodiment of the present disclosure.

In an embodiment, as shown in FIG. 10, the air replenishing pump 5 includes a housing 21, two opposite ends of which are respectively provided with the outer air inhaling port 10 and the above air ejector pipe 11. Referring to FIGS. 14-17, the housing 2 is mounted inside with an air replenishing motor 22, an eccentric wheel 23, a shifting lever 24, a shifting disc 25 and four elastic airbags 26. More specifically, an eccentric hole 27 is obliquely provided in the eccentric wheel 23, and forms a certain included angle with a rotating central hole of the eccentric wheel 23. A rotating shaft of the air replenishing motor 22 is sleeved to the rotating central hole of the eccentric wheel 23 to drive the eccentric wheel 23 to rotate. Moreover, one end of the shifting lever 24 is inserted into the eccentric hole 27, and the other end of the shifting lever 24 is inserted into the central hole of the shifting disc 25. The four elastic airbags 26 are circumferentially arranged and surround the rotating central hole of the eccentric wheel 23. An air outlet 261 of each of the elastic airbags 26 is communicated with the air ejector pipe 11, such that the air ejected by the elastic airbags 26 can enter the air ejector pipe 11 through the air outlets 261.

Through the above structure, when it is necessary for the air replenishing pump 5 to output air, the air replenishing motor 22 drives the eccentric wheel 23 to rotate. During the rotation, the eccentric wheel 23 can drive, through the eccentric hole 27 and the shifting lever 24, the shifting disc 25 to circumferentially oscillate, then the shifting disc 25 can circumferentially oscillate with the rotation of the eccentric wheel 23. In this process, the circumferentially oscillating shifting disc 25 can sequentially compress the elastic airbags 26. Then the elastic airbags 26 that are sequentially compressed can sequentially compress the air inside itself and drive the internal air to be outputted into the air ejector pipe 11 through the air outlets 261, and to finally enter the inner cavity of the inflatable product through the air ejector pipe 11, achieving the air replenishing function of the air replenishing pump 5 for the inflatable product. However, in the process of sequentially compressing the elastic airbags 26 by the shifting disc 25, the compressed elastic airbags 26 recover the expansion respectively after a compressing force is removed, such that the elastic airbags 26 that have already output air can automatically inhale again, so as to prepare for outputting air after being compressed by the shifting disc 25 for the next time. The structure is much simpler and more compact, such that the air replenishing pump 5 outputs the air more efficiently.

Figure 11:
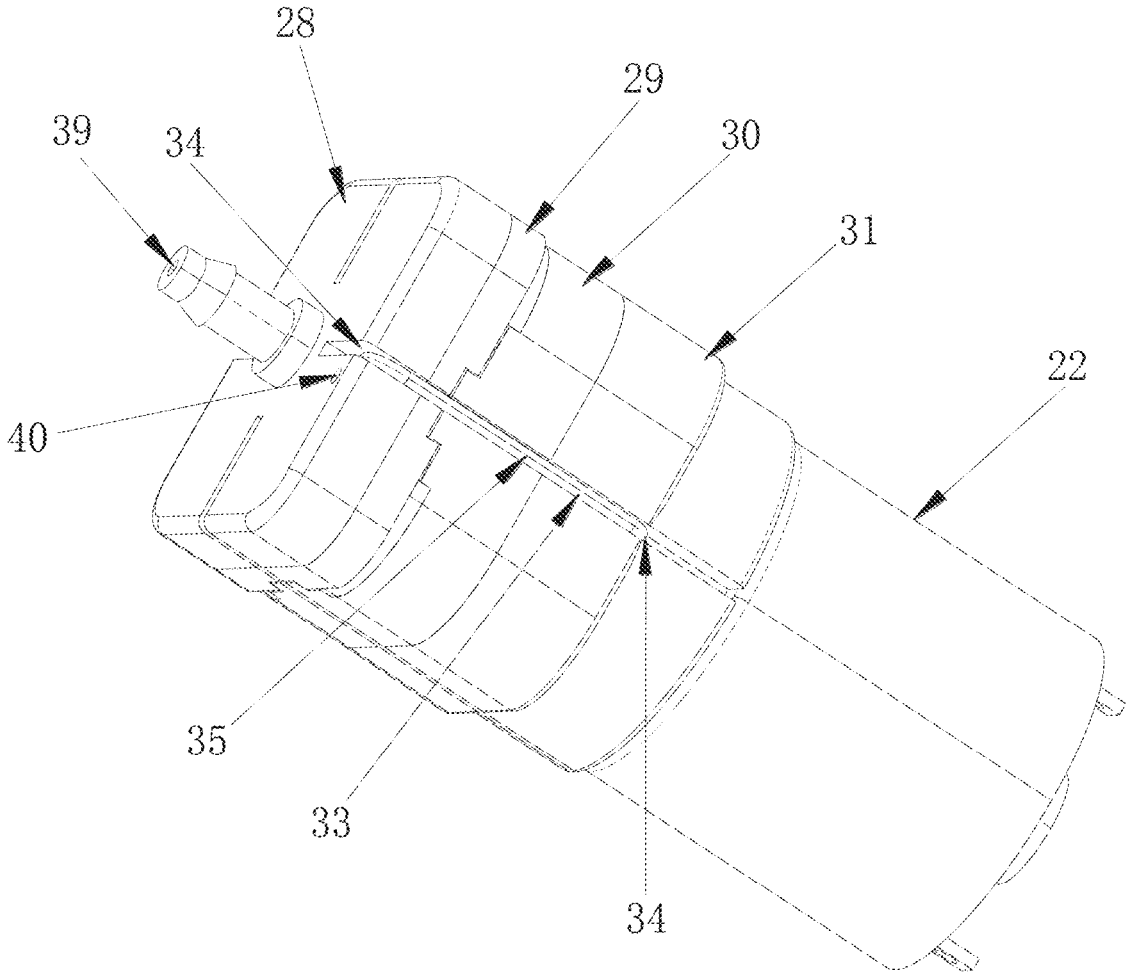
FIG. 11 is an internal structure diagram of FIG. 10, with a housing 21 hidden.
Figure 13:
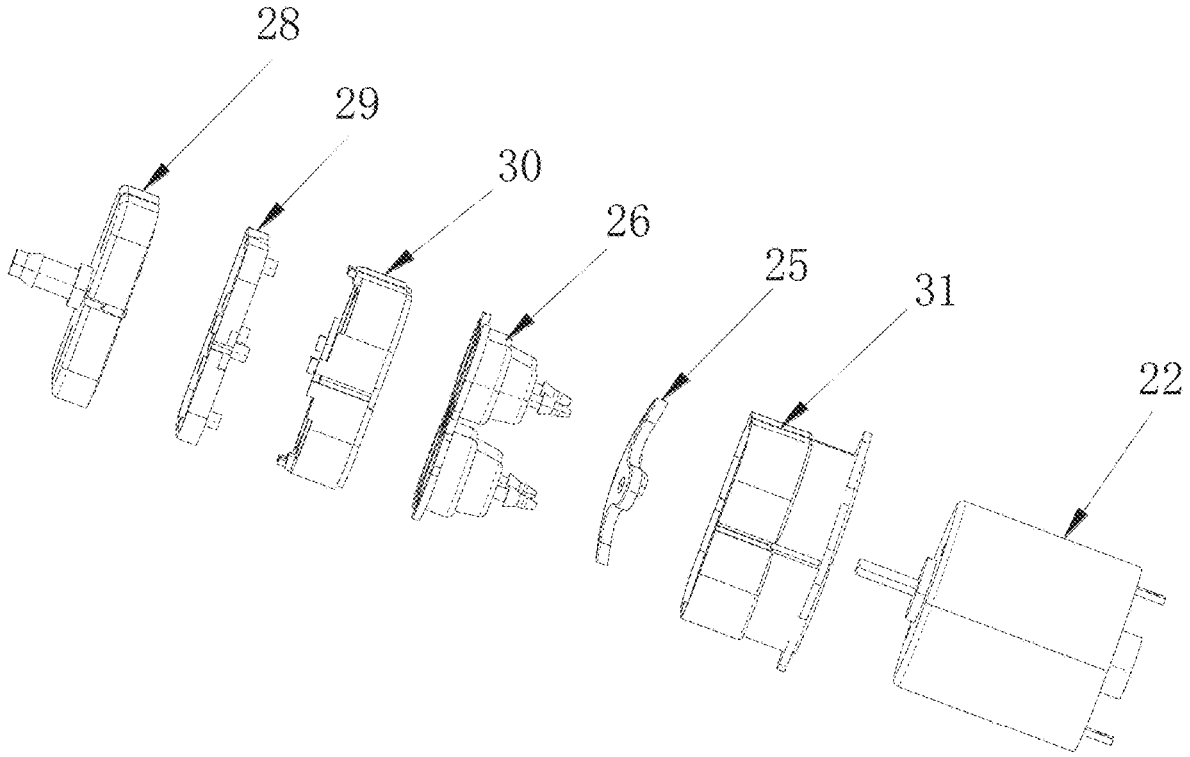
FIG. 13 is an exploded view of FIG. 10.
Figure 14:
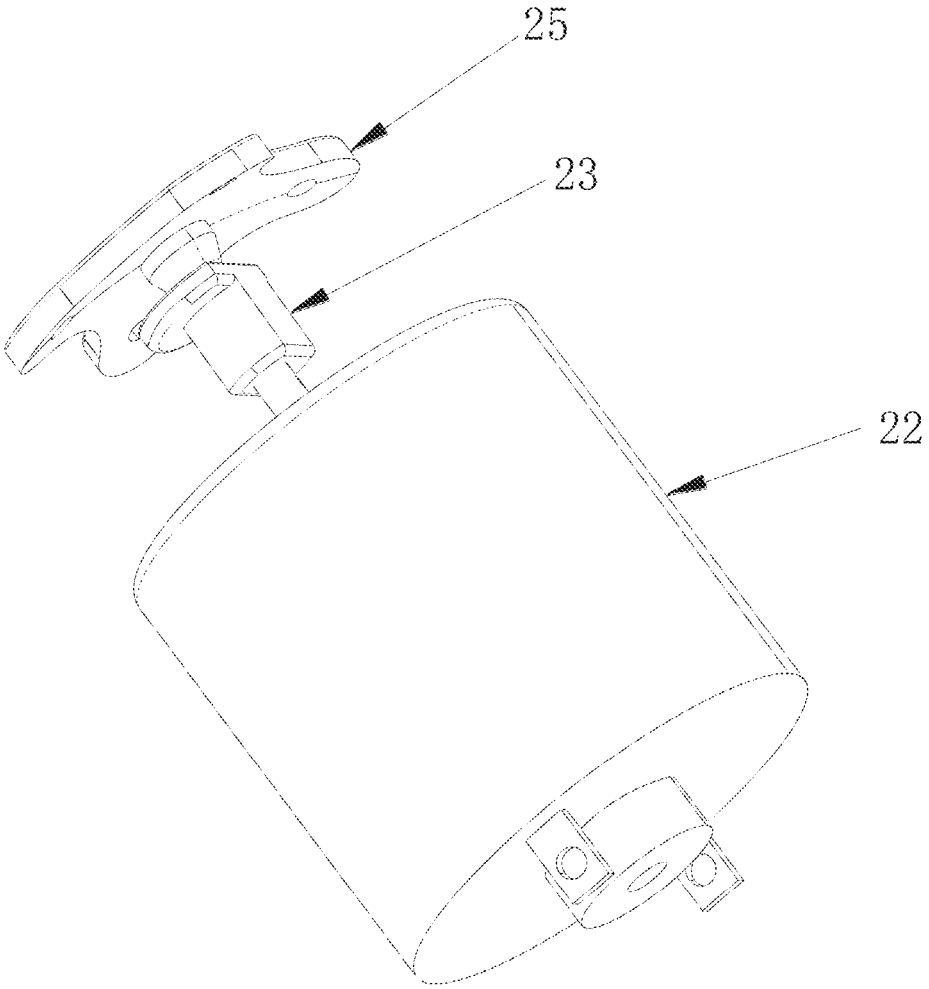
FIG. 14 is a partially structural diagram of FIG. 10.
Figure 15:
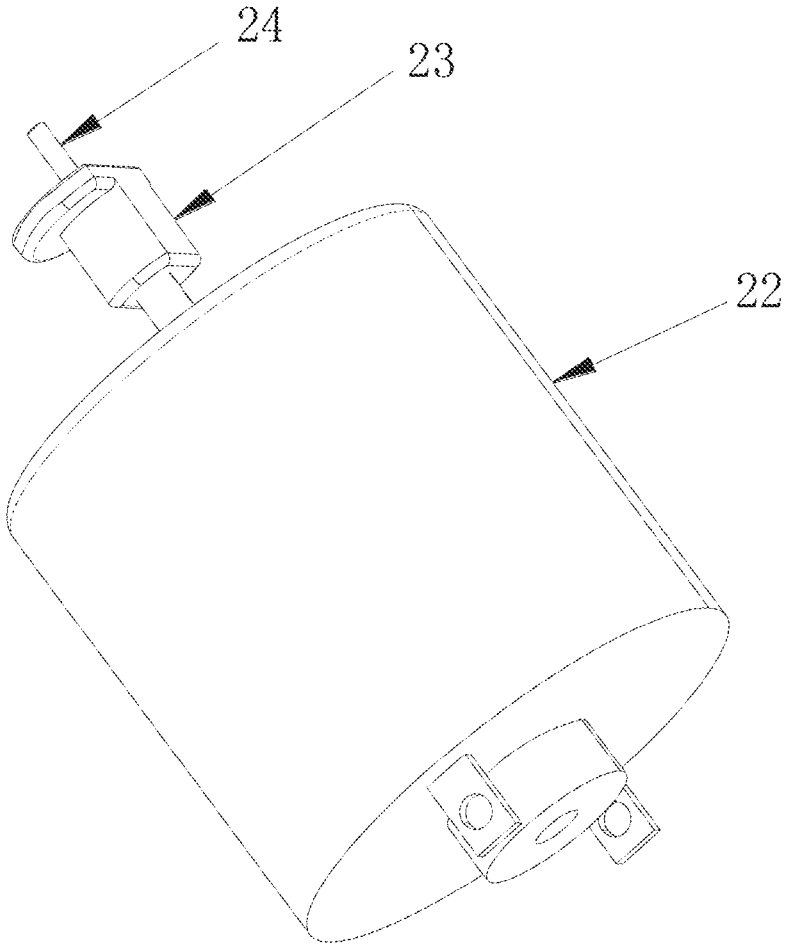
FIG. 15 is another partially structural diagram of FIG. 10.
Figure 16:
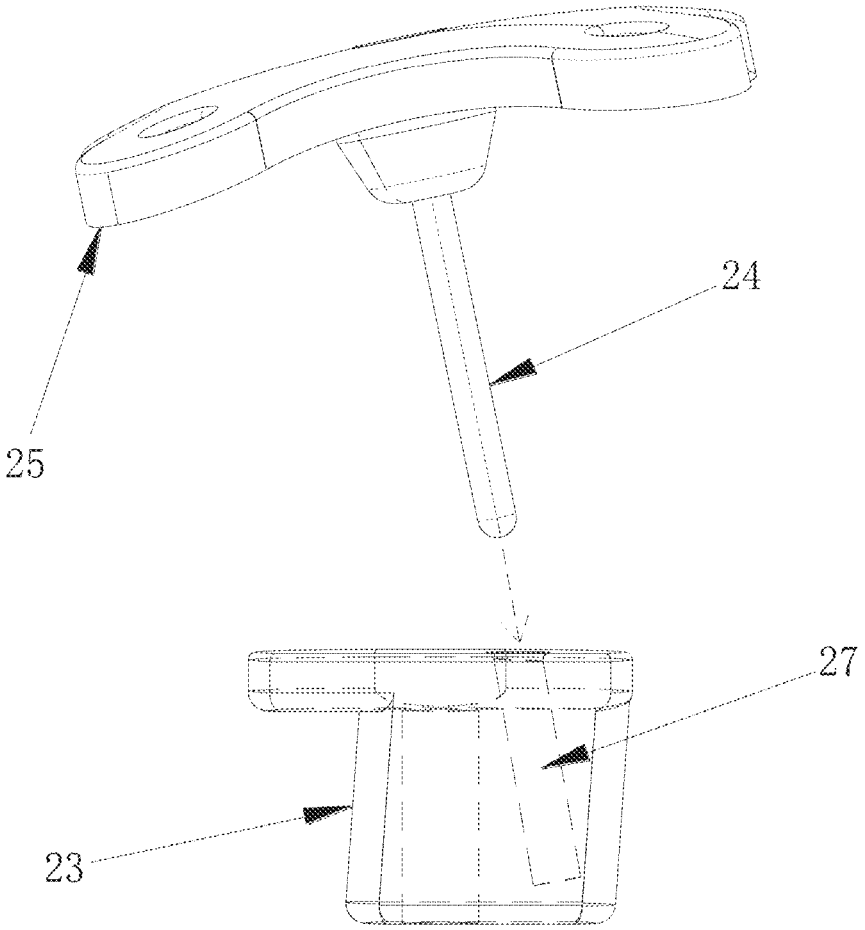
FIG. 16 is another partially assembly schematic diagram of FIG. 10.
Figure 17:
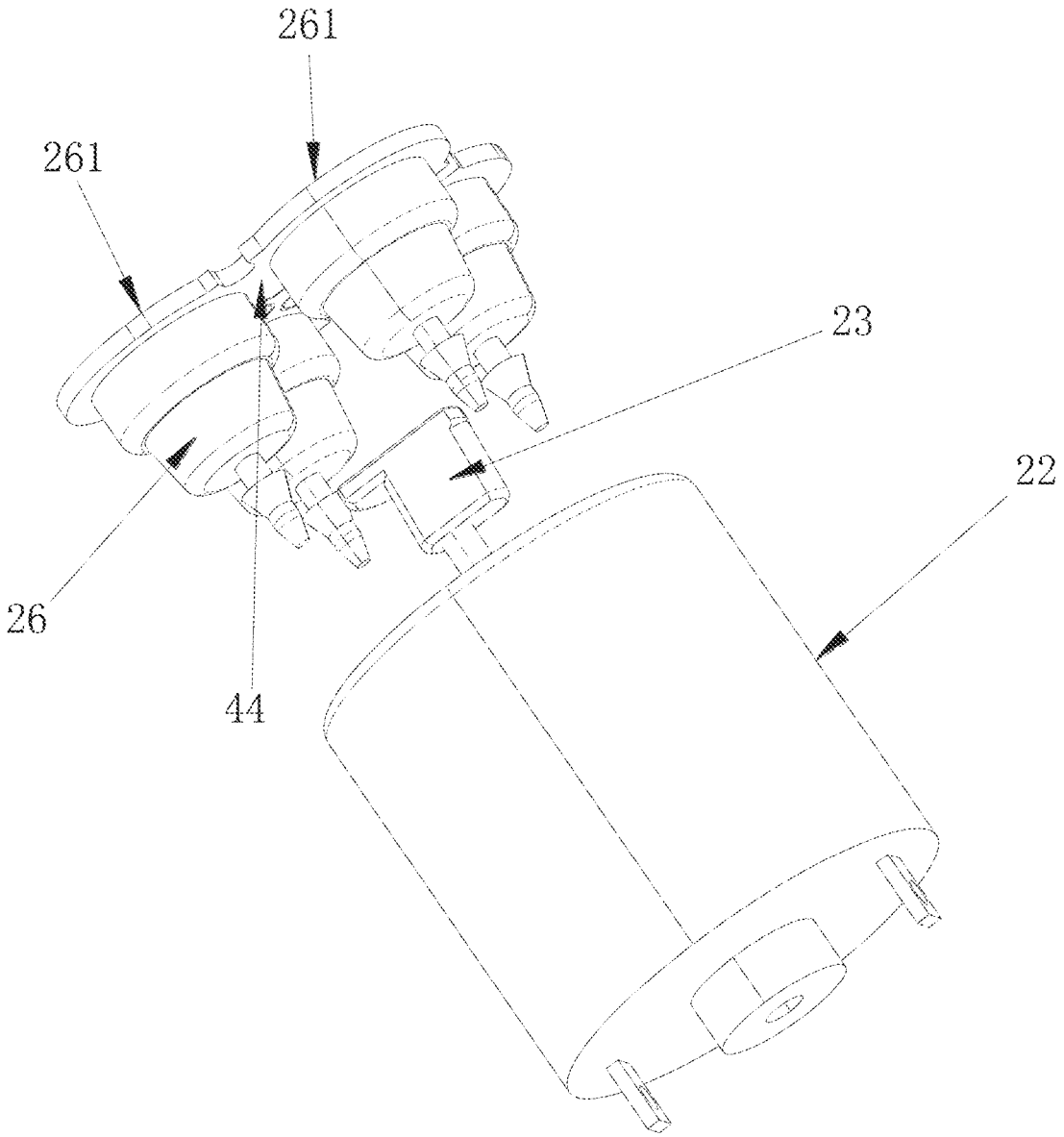
FIG. 17 is another partially structural diagram of FIG. 10.
Figure 18:
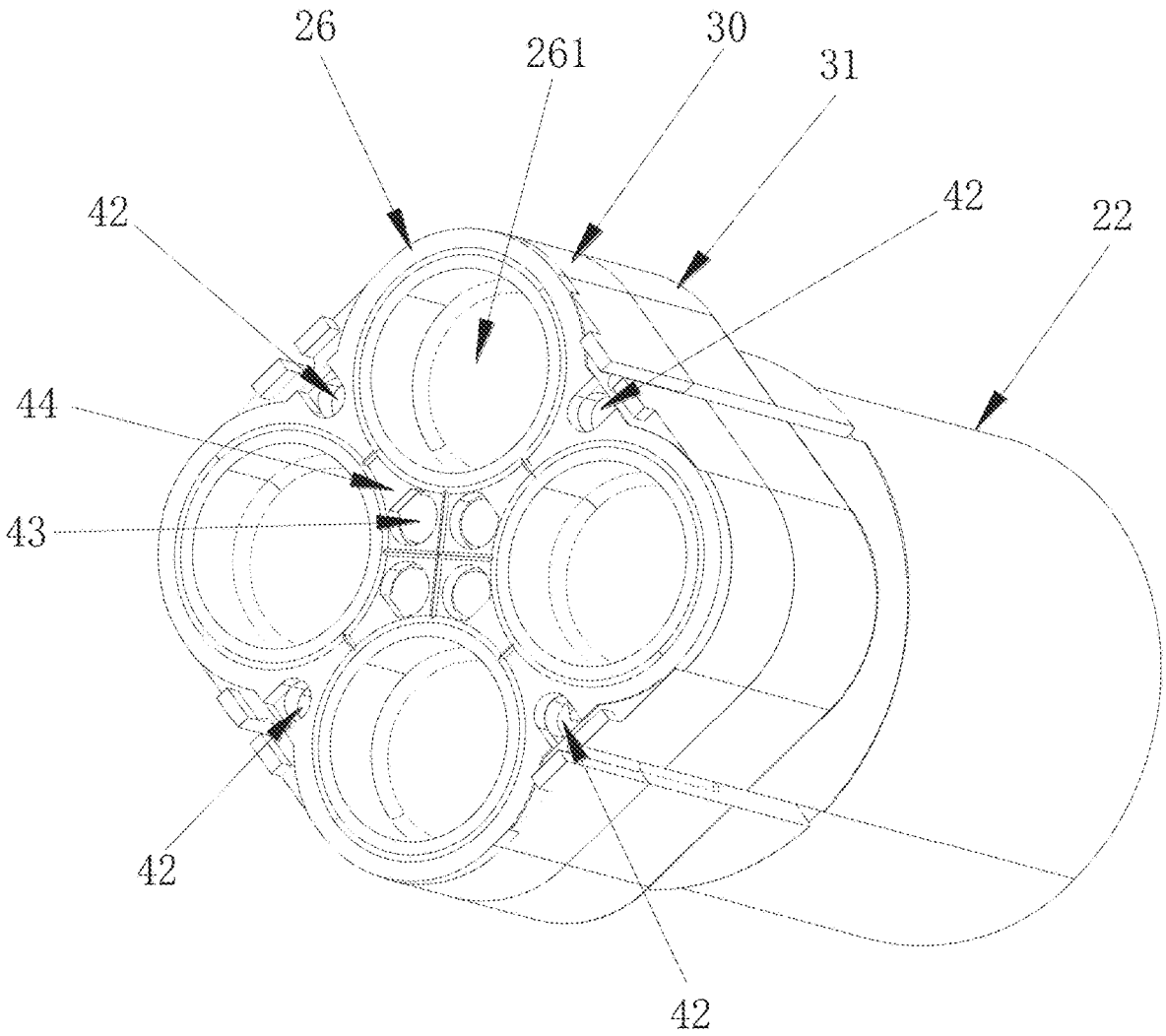
FIG. 18 is another partially structural diagram of FIG. 10.

In an embodiment, referring to FIGS. 11 and 13, the housing 21 is internally provided with an air outlet cover 28, an air replenishing seat 29, a front fixing seat 30 and a rear fixing seat 31 which are butted with each other sequentially. The air ejector pipe 11 is connected into the inner cavity of the air outlet cover 28. Mounting positions matching with the elastic airbags 26 are integrally formed within the front fixing seat 30, such that the elastic airbags 26 each can be fixedly sleeved within the front fixing seat 30. The housing of the air replenishing motor 22 is fixedly butted with the rear fixing seat 31. The eccentric wheel 23, the shifting lever 24 and the shifting disc 25 are respectively accommodated and mounted within the rear fixing seat 31. In addition, the air replenishing seat 29 is provided thereon with four vent holes 32 (FIGS. 19, 20 and 24) which are respectively communicated with the inner cavity of the air outlet cover 28. After the assembling is completed, the air outlets 261 of the four elastic airbags 26 are respectively mutually butted and communicated with the four vent holes 32 one by one.

Through this structure, when the elastic airbags 26 are sequentially compressed by the shifting disc 25 and output the air, the air outputted from each of the air outlets 261 can continue to enter the inner cavity of the air outlet cover 28 through the four vent holes 32 in the air replenishing seat 29, and after reaching the inner cavity of the air outlet cover 28, the airflow can smoothly enter the air ejector pipe 11 and be output, achieving the outwards air supply of the air replenishing pump 5.

Figure 12:
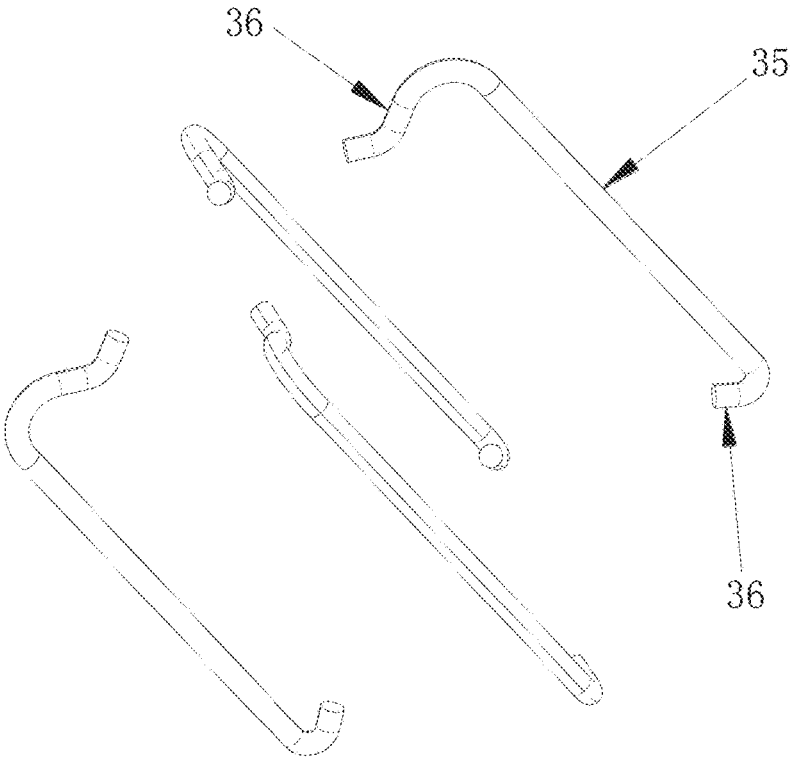
FIG. 12 is a structural diagram of a connecting rod according to an embodiment of the present disclosure.

In an embodiment, as shown in FIG. 11, the structure of the air replenishing pump 5 further includes a plurality of connecting grooves 33, each of which is circumferentially arranged, and integrally formed respectively on the outer walls of the air outlet cover 28, the air replenishing seat 29, the front fixing seat 30 and the rear fixing seat 31, which is equivalent to that the connecting grooves 33 are separately formed on the outer walls of the air outlet cover 28, the air replenishing seat 29, the front fixing seat 30 and the rear fixing seat 31, such that the connecting grooves 33 span the outer walls of the air outlet cover 28, the air replenishing seat 29, the front fixing seat 30 and the rear fixing seat 31. Both ends of each of the connecting groove 33 are respectively formed with buckling positions 34 on the outer walls of the air outlet cover 28 and the rear fixing seat 31, that is, the buckling positions 34 are formed only on the outer walls of the air outlet cover 28 and the rear fixing seat 31. A connecting rod 35 is fittingly sleeved inside each of the connecting groove 33. Both ends of the connecting rod 35 are respectively formed with a buckle 36 (as shown in FIG. 12). The connecting rod 35 is fixedly buckled to the buckling positions 34 on the outer wall of the air outlet cover 28 and the rear fixing seat 31 through the buckles 36 at both ends. Therefore, under a joint buckling of a plurality of connecting rods 35, the air outlet cover 28, the air replenishing seat 29, the front fixing seat 30 and the rear fixing seat 31 can be simply and stably connected into a whole, making the assembling simpler.

Figure 19:
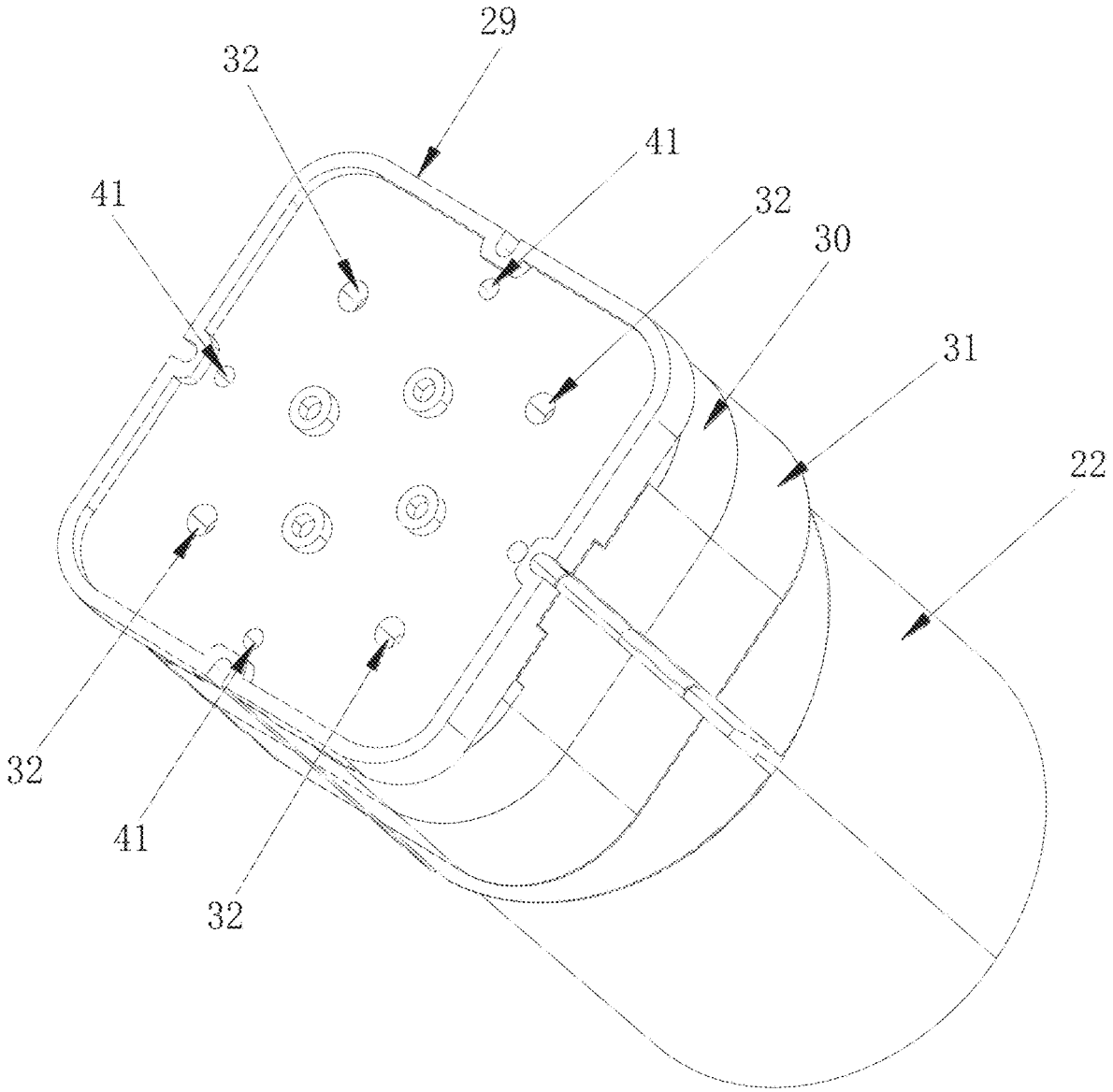
FIG. 19 is another partially structural diagram of FIG. 10.
Figure 20:
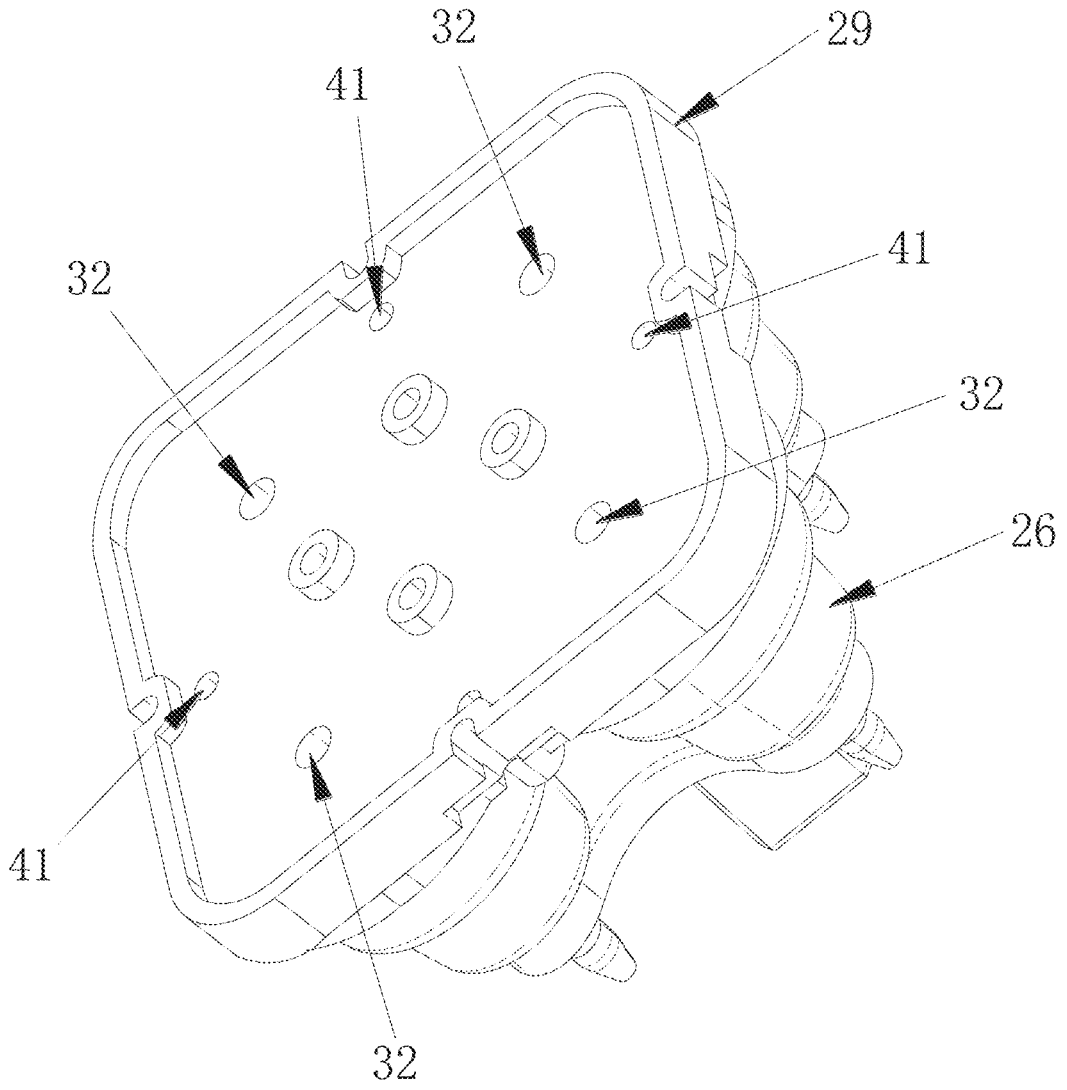
FIG. 20 is another partially structural diagram of FIG. 10.
Figure 21:
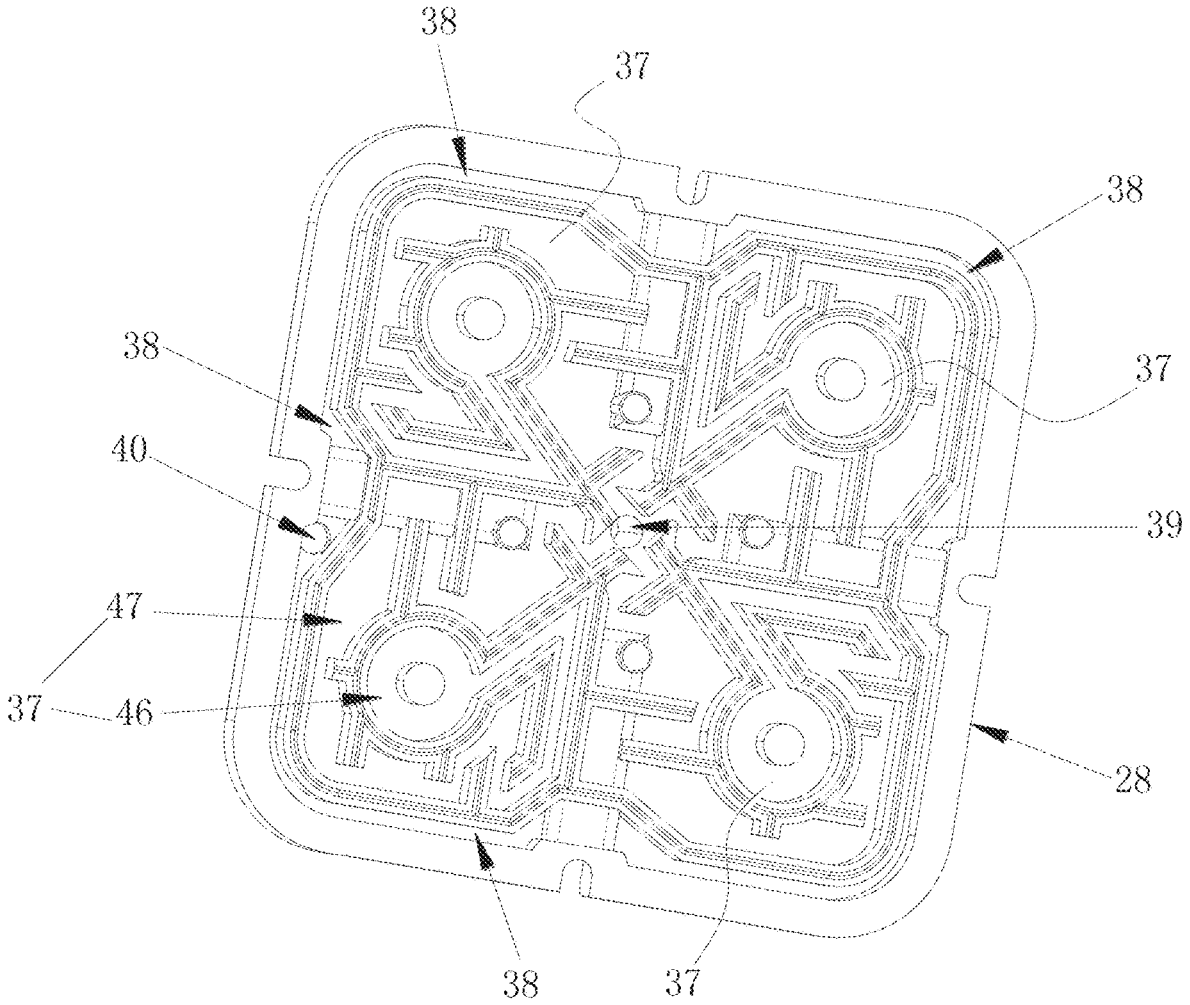
FIG. 21 is a structural diagram of an inner cavity of an air outlet cover of an air replenishing pump portion according to an embodiment of the present disclosure.
Figure 22:
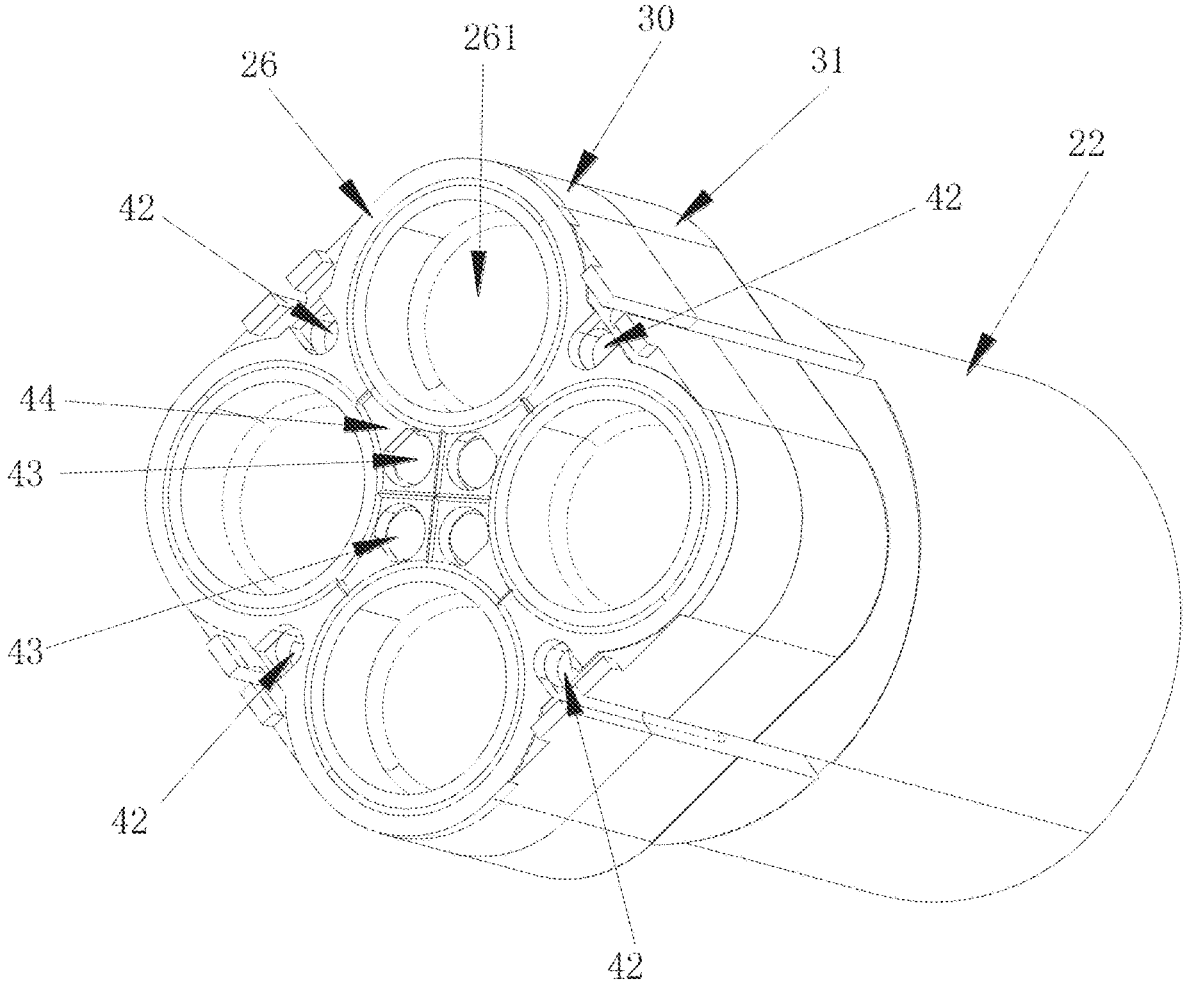
FIG. 22 is another partially structural diagram of FIG. 10.
Figure 23:
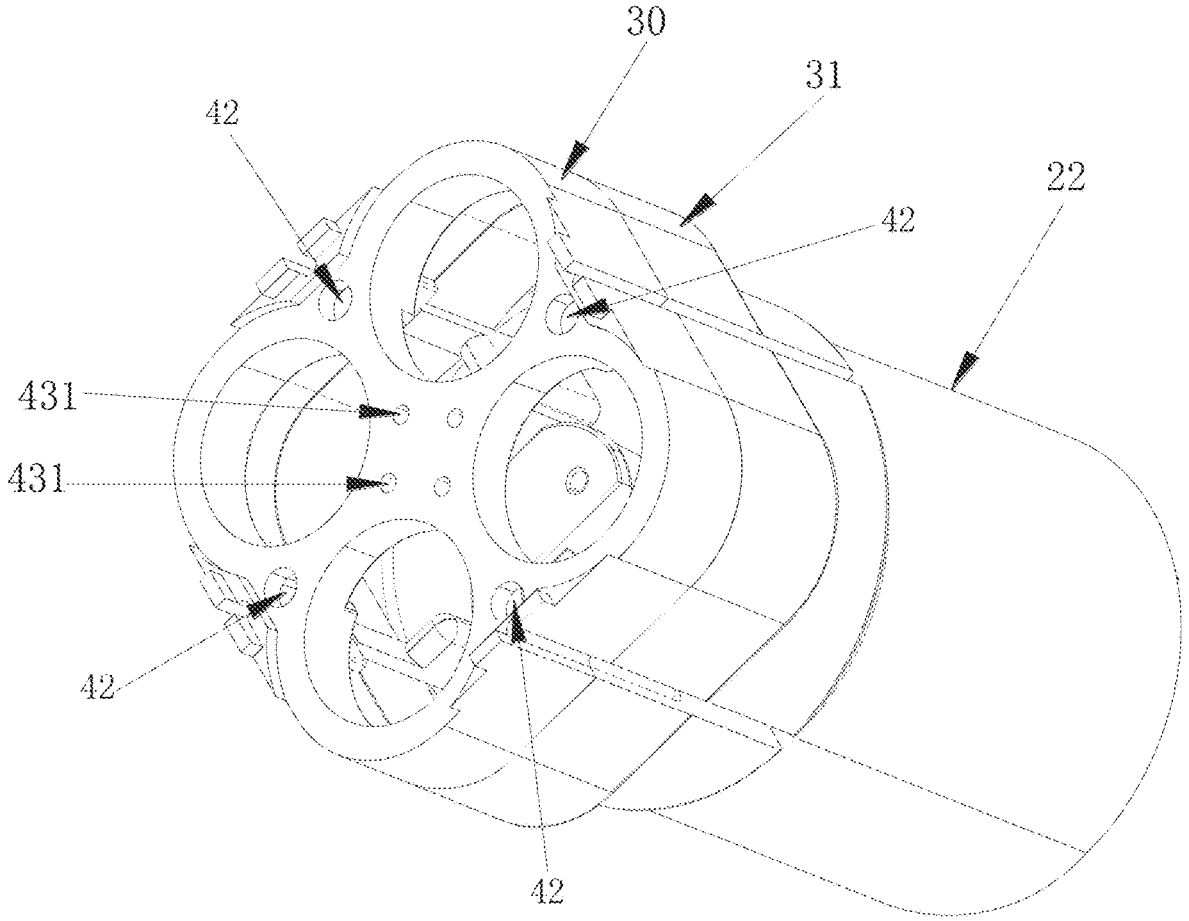
FIG. 23 is another partially structural diagram of FIG. 10.
Figure 24:
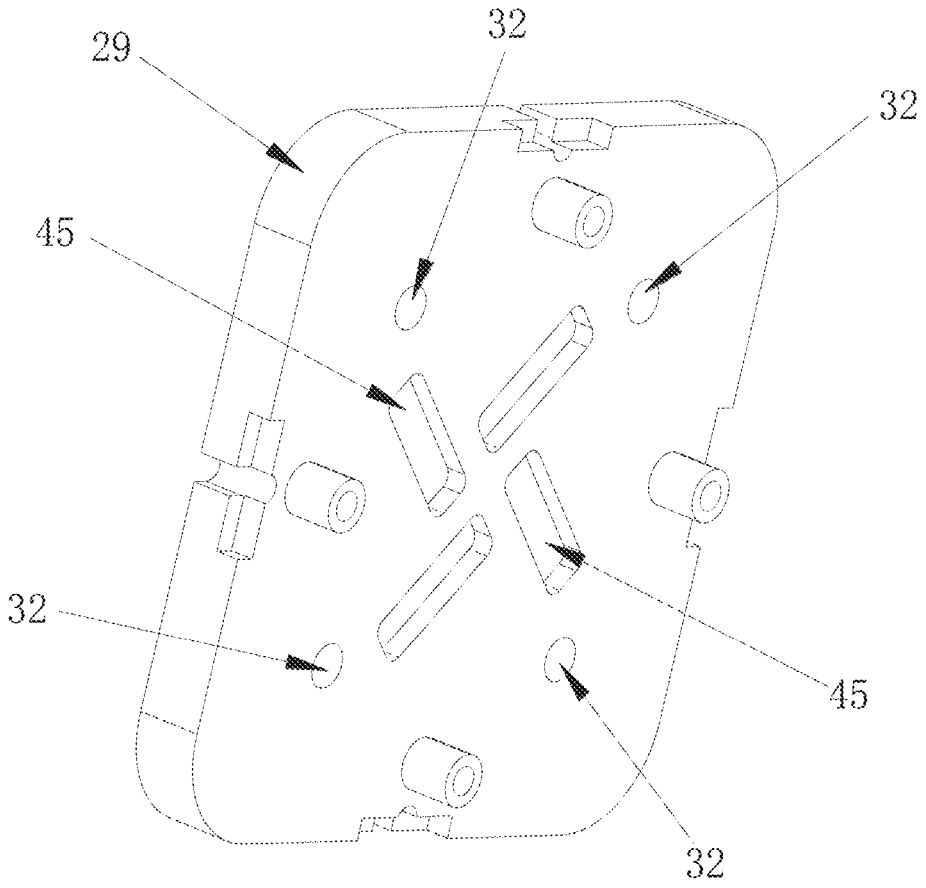
FIG. 24 is a back structural diagram of an air replenishing seat of an air replenishing pump portion according to an embodiment of the present disclosure.

Referring to FIGS. 18-24, in an embodiment, as shown in FIG. 21, the inner cavity of the air outlet cover 28 is separated into four air ejector cavities 37 and an annular cavity 38. The four air ejector cavities 37 meet and communicate at the center. The annular cavity 38 is mutually separated from the four air ejector cavities 37. Meanwhile, the air outlet cover 28 is also provided thereon with an air ejector hole 39 and an inner air inhaling port 40. The air ejector hole 39 is located at the center of the air outlet cover 28 and conFIGured to be butted and communicated with the air ejector pipe 11. Moreover, the four air ejector cavities 37 surround the air ejector hole 39 and are jointly communicated with the air ejector hole 39 in the center, so the air within the four air ejector cavities 37 can be outputted to the air ejector pipe 11 of the air replenishing pump 5 through the air ejector hole 39 in the center. Moreover, the annular cavity 38 surrounds the periphery of each of the air ejector cavities 37, and the annular cavity 38 is communicated with the inner air inhaling port 40, such that the air can enter the annular cavity 38 inside the air outlet cover 28 through the inner air inhaling port 40. In another aspect, a clearance channel (not shown in the drawings) is formed between the inner wall of the housing 21 and the outer walls of the air replenishing motor 22, the rear fixing seat 31, the front fixing seat 30, the air replenishing seat 29 and the air outlet cover 28, and both ends of the clearance channel are respectively communicated with the inner air inhaling port 40 and the outer air inhaling port 10, such that the air in the air duct inside the mounting housing 1 can enter the above clearance channel through the outer air inhaling port 10 of the air replenishing pump 5, and reach the inner air inhaling port 40 of the air outlet cover 28 through the above clearance channel and smoothly enter the annular cavity 38 inside the air outlet cover 28. In yet another aspect, as shown in FIGS. 19 and 20, the air replenishing seat 29 is also provided thereon with four circumferentially distributed first air inhaling through holes 41, each of which has one end communicated with the annular cavity 38 of the air outlet cover 28, and the other end communicated with the inner cavity formed inside the front fixing seat 30. Specifically, referring to FIGS. 18, 22 and 23, the front fixing seat 30 is provided thereon with four second air inhaling through holes 42, each of which has one end communicated with the inner cavity of the front fixing seat 30, and the other end butted and communicated with each of the first air inhaling through holes 41 in the air replenishing seat 29, such that the first air inhaling through holes 41 in the air replenishing seat 29 can be communicated with the inner cavity of the front fixing seat 30. The four elastic airbags 26 are integrally formed on a substrate 44, which is mounted between the air replenishing seat 29 and the front fixing seat 30. The substrate 44 is provided thereon with four third air inhaling through holes 43. The front fixing seat 30 is also provided, at a position corresponding to each of the third air inhaling through holes 43, with four fourth air inhaling through holes 431 (FIG. 23), each of which has one end communicated with the inner cavity of the front fixing seat 30, and the other end butted and communicated with each of the third air inhaling through holes. As shown in FIG. 24, the air replenishing seat 29 is integrally formed thereon with four air replenishing grooves 45, each of which has one end communicated with the air outlet 261 of a respective one of the elastic airbags 26, and the other end communicated with a respective one of the third air inhaling through holes 43, that is, both ends of an air replenishing groove 45 are respectively communicated with a third air inhaling through hole 43 in a substrate 44 and an air outlet 261 on an elastic airbag 26. Finally, referring to FIG. 21, inside the air outlet cover 28, a central cavity 46 is defined within each of the four air ejector cavities 37. Each central cavity 46 is hermetically butted and communicated with a respective one of the air vent holes 32 in the air replenishing seat 29. A multi-section tortuous channel 47 is further defined within each of the air ejector cavities 37. The multi-section tortuous channel 47 surrounds the periphery of the central cavity 46, and has one end communicated with the central cavity 46, and the other end communicated with the air ejector hole 39 in the center of the air outlet cover 28.

Through this structure, the external air can enter the clearance channel of the housing 21 of the air replenishing pump 5 through the outer air inhaling port 10 of the air replenishing pump 5, continue to enter the annular cavity 38 inside the air outlet cover 28 through the inner air inhaling port 40 on the air outlet cover 28, and after entering the annular cavity 38, can continue to smoothly enter the inner cavity of the front fixing seat 30, sequentially through the first air inhaling through holes 41 and the second air inhaling through holes 42 of the air replenishing seat 29. When the elastic airbags 26 each need to inhale air and resile after being compressed, the air that enters the inner cavity of the front fixing seat 30 from the outside can smoothly enter the air outlets 261 of the elastic airbags 26, sequentially through the fourth air inhaling through holes 431 of the front fixing seat 30, the third air inhaling through holes 43 of the substrate 44 and the air replenishing grooves 45 of the air replenishing seat 29, ensuring that the elastic airbags 26 can smoothly inhale air and resile. In addition, the elastic airbags 26 that are compressed by the shifting disc 25 can also drive the internal air to enter each of the central cavities 46 of the air outlet cover 28, sequentially through the air outlets 261 and the vent holes 32 of the air replenishing seat 29. The airflow that enters the central cavities 46 continues to flow to the air ejector hole 39 at the center of the air outlet cover 28 along the above multi-section tortuous channel 47, and finally can be outputted through the air ejector pipe 11 of the air replenishing pump 5, such that the air replenishing pump 5 can smoothly output air for replenishing to the inner cavity of the inflatable product, achieving the air replenishing function of the air pump device for the inflatable product. It should also be noted that due to the tortuous structure inside the multi-section tortuous channel 47, the airflow can be subjected to more resistance in the process of flowing through the multi-section tortuous channel 47, such that the noise generated by the airflow can be reduced, and the air replenishing pump 5 can be quieter during the operation.

Figure 25:
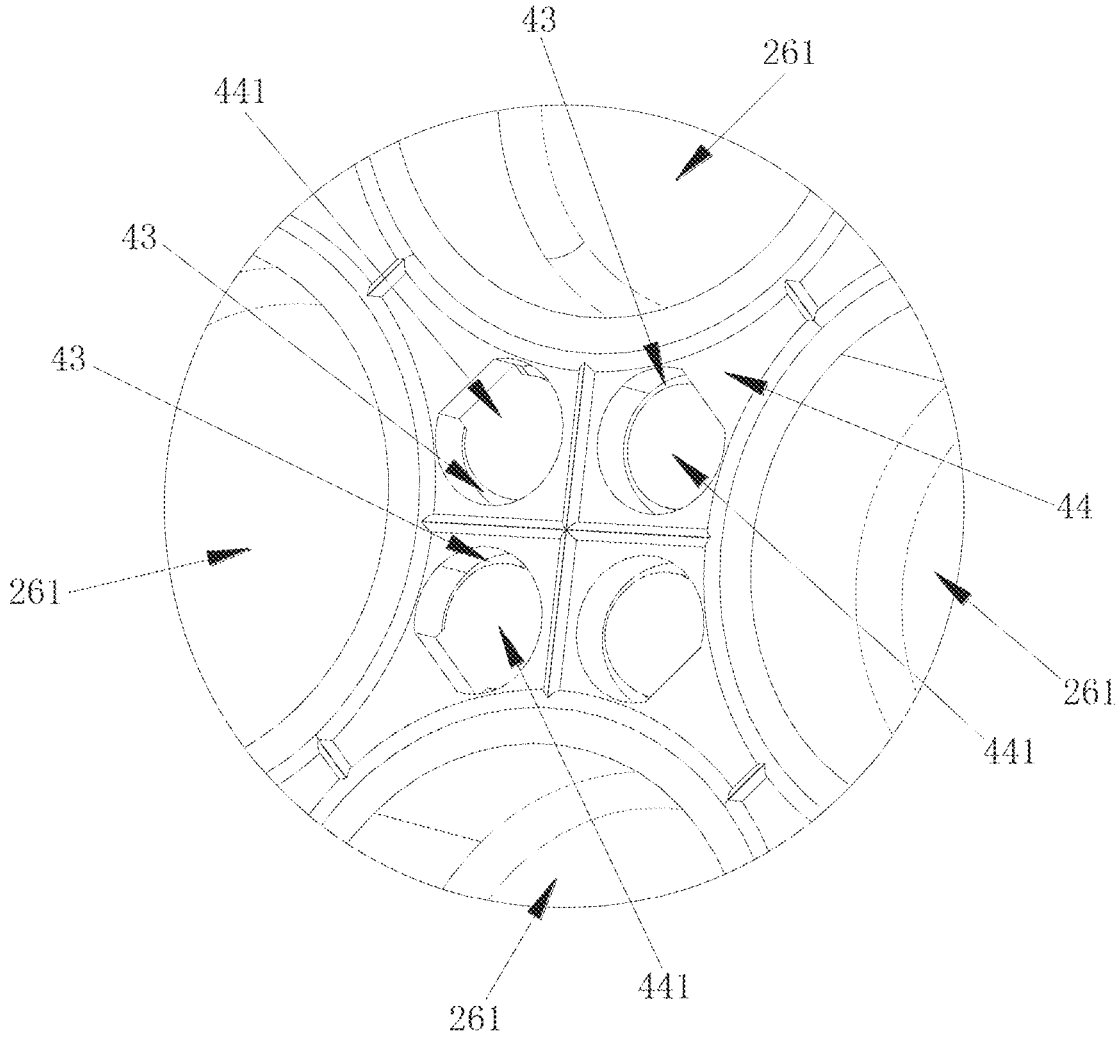
FIG. 25 is a partially enlarged view of FIG. 10.

In an embodiment, as shown in FIG. 25, the substrate 44 is integrally formed thereon with a plurality of first elastic valve plates 441 respectively located within each of the third air inhaling through holes 43. The thickness of the first elastic valve plates 441 is smaller than that of the substrate 44, and the first elastic valve plates 441 are located on the side close to the front fixing seat 30, with a certain distance from the air replenishing grooves 45. The first elastic valve plates 441 are fitted to the plane of the front fixing seat 30 and close a respective one of the second air inhaling through holes 42 in the front fixing seat 30. It can be appreciated that under the blocking effect of the plane of the front fixing seat 30, the first elastic valve plates 441 each cannot move towards the front fixing seat 30, and since there is a certain distance between the first elastic valve plates 441 and the air replenishing grooves 45, the first elastic valve plates 441 can move towards the air replenishing grooves 45. Through this structure, the first elastic valve plates 441 each can only move unidirectionally towards the air replenishing grooves 45. Therefore, in the process in which the elastic airbags 26 are sequentially compressed and output the airflow, the first elastic valve plates 441 each can block the airflow outputted from the elastic airbag 26 from reversely entering each of the second air inhaling through holes 42 in the front fixing seat 30, ensuring the unidirectional flow of the airflow within the air replenishing pump 5.

Figure 26:
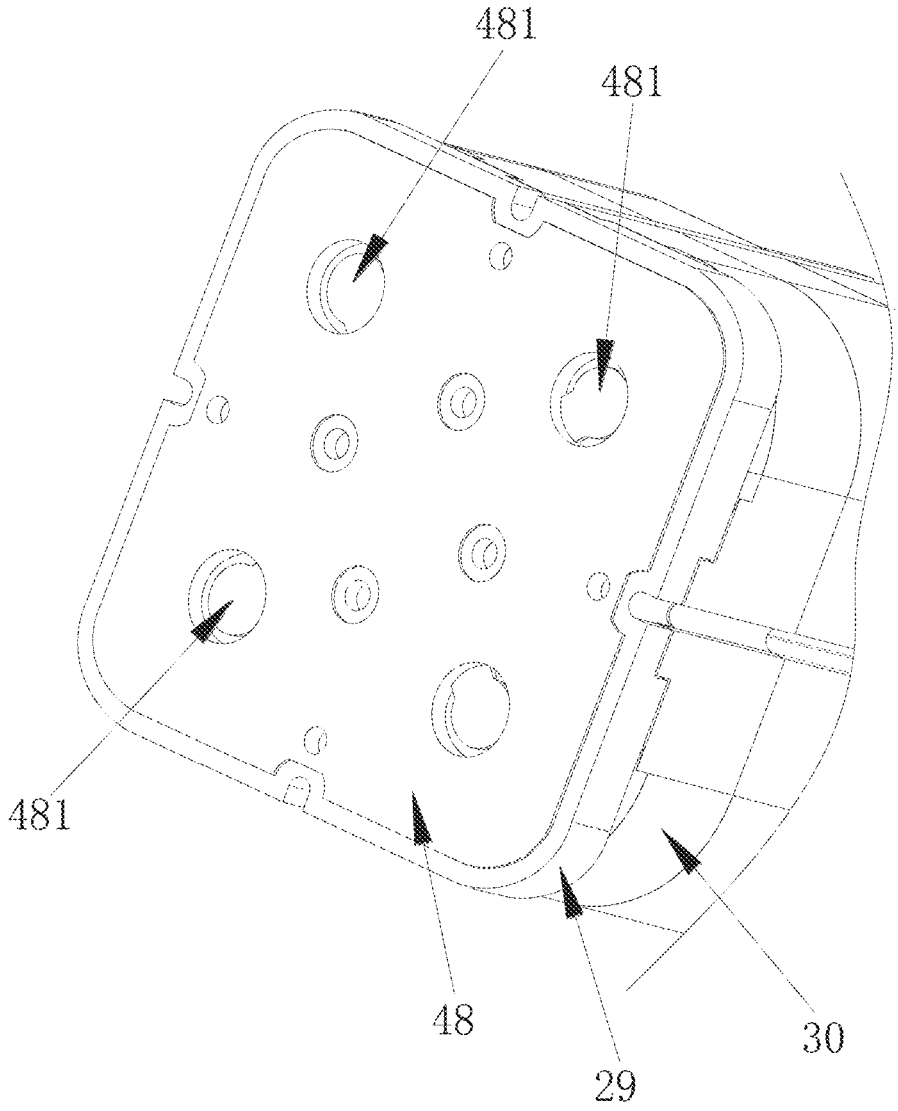
FIG. 26 is another partially structural diagram of FIG. 10.

In an embodiment, as shown in FIG. 26, a sealing gasket 48 is provided between the air outlet cover 28 and the air replenishing seat 29. The sealing gasket 48 is sandwiched between the air outlet cover 28 and the air replenishing seat 29. Moreover, the sealing gasket 48 is integrally formed thereon with a plurality of second elastic valve plates 481. The thickness of the second elastic valve plates 481 is smaller than that of the sealing gasket 48, and the second elastic valve plates 481 are located at the side close to the air replenishing seat 29, with a certain distance from the air outlet cover 28. The second elastic valve plates 481 are fitted to the plane of the air replenishing seat 29 and close a respective one of the vent holes 32 in the air replenishing seat 29.

Under the blocking effect of the plane of the air replenishing seat 29, the second elastic valve plates 481 each cannot move towards the air outlet cover 28, and since there is a certain distance between the second elastic valve plates 481 and the air outlet cover 28, the second elastic valve plates 481 can move towards the air outlet cover 28. Through this structure, the second elastic valve plates 481 each can only move unidirectionally towards the air outlet cover 28. Therefore, when the elastic airbags 26 each sequentially output the airflow that enters each of the vent holes 32, the second elastic valve plates 481 in front of each of the vent holes 32 can be pushed away sequentially, such that the airflow can smoothly pass through the vent holes 32 and be delivered to the air outlet cover 28. In this process, the second elastic valve plates 481 that are not pushed away by the airflow from the elastic airbags 26 can block the airflow that has entered the inner cavity of the air outlet cover 28 from reversely entering the vent holes 32, ensuring that in the process in which the air replenishing pump outputs the airflow, the airflow will not be mixed with each other between the vent holes 32, and ensuring the unidirectional flow of the airflow within the air replenishing pump 5.

Returning to FIGS. 2-4 again, in an embodiment, the mounting housing 1 is further internally provided with a first partition board 101 and a second partition board 102. The first partition board 101 separates the interior of the mounting housing 1 into a left cavity and a right cavity. The blower 100 is mounted within the left cavity, whereas the air replenishing pump 5, the control system 4, the air pressure sensor 7, the detection port 8 and the air pressure collecting pipe 9 are mounted within the right cavity. In addition, an air duct box 107 and an L-shaped switching pipe 108 are further mounted at the bottom of the right cavity. The L-shaped switching pipe 108 is controlled by an electromagnetic valve (not shown in the drawings) inside the mounting housing 1, such that the L-shaped switching pipe 108 can move up and down. Moreover, the second partition plate 102 separates the left cavity into an upper cavity and a lower cavity. The upper cavity is an air blowing cavity 103, and the lower cavity is an air inhaling cavity 104. The blower 100 is a centrifugal blower, the centrifugal blades of the blower 100 are located within the upper air blowing cavity 103, and the center of the centrifugal blades of the blower 100 is downward communicated with the lower air inhaling cavity 104. Meanwhile, the first partition plate 101 is provided thereon with blowing outlets 105 and inhaling inlets 106 that are distributed up and down, in which the blowing outlets 105 are communicated with the air blowing cavity 103, and the inhaling inlets 106 are communicated with the air inhaling cavity 104, such that when the centrifugal blower rotates, the diffused airflow generated by the centrifugal blades can be blown out from the air blowing cavity 103 through the blowing outlets 105, and moreover, the external air can enter the air inhaling cavity 104 through the inhaling inlets 106. During the assembling, the lower port of the L-shaped switching pipe 108 is slidably inserted into the air duct box 107, the interior of which is communicated with the valve port 3 at the bottom of the mounting housing 1. When the L-shaped switching pipe 108 moves upward, its left port is communicated with the blowing outlets 105 of the first partition plate 101, whereas when the L-shaped switching pipe 108 moves downward, its left port is communicated with the inhaling inlets 106 of the first partition plate 101.

Therefore, when it is necessary for the air pump device to inflate the inflatable product, the control system 4 controls the L-shaped switching pipe 108 to move up through the electromagnetic valve, such that the L-shaped switching pipe 108 is butted with the blowing outlets 105 to access the air blowing cavity 103, and further starts the centrifugal blower to drive the air within the air blowing cavity 103 to enter the L-shaped switching pipe 108 and continue to enter the air duct box 107. Meanwhile, the control system 4 further opens the valve of the valve port 3, such that the airflow within the air duct box 107 can be smoothly outputted to the inner cavity of the inflatable product through the valve port 3. In this process, under the effect of the centrifugal blower, a negative pressure will be formed inside the air inhaling cavity 104. In this case, since the L-shaped switching pipe 108 is not butted with the inhaling inlets 106 to communicate the air inhaling cavity 104 with the right cavity of the mounting housing 1, the external air can, under the effect of the negative pressure, automatically enter the inner cavity of the mounting housing 1 through the external air vent 2 of the mounting housing 1 and continue to automatically enter the air inhaling cavity 104 through the inhaling inlets 106, so as to replenish air to the air inhaling cavity 104, ensuring that the centrifugal blower can normally pump in the air within the air inhaling cavity 104 and deliver it to the L-shaped switching pipe 108. On the contrary, when it is necessary for the air pump device to deflate the inflatable product, the control system 4 controls the L-shaped switching pipe 108 to move down through the electromagnetic valve, such that the L-shaped switching pipe 108 is butted with the inhaling inlets 106 to access the air inhaling cavity 104. In this case, the L-shaped switching pipe 108 is not butted with the blowing outlets 105 to communicate the air blowing cavity 103 with the right cavity of the mounting housing 1, such that starting the centrifugal blower at this time can enable the centrifugal blades to drive the air within the air blowing cavity 103 to be outputted to the blowing outlets 105, to enter the right cavity of the mounting housing 1, and finally to be exhausted to the outside through the external air vent 2 of the mounting housing 1. Meanwhile, the center of the centrifugal blades continuously pumps in the air within the air inhaling cavity 104, such that a negative pressure is formed inside the air inhaling cavity 104, and the internal air of the inflatable product can automatically enter the valve port 3 and continue to enter the air duct box 107 and the L-shaped switching pipe 108, and finally flows back to the air inhaling cavity 104 through the inhaling inlets 106. As the air that flows back to the air inhaling cavity 104 continues to be exhausted to the outside through the air blowing cavity 103, the air pump device can finally pump out the internal air of the inflatable product, achieving the later recovery of the inflatable product.

At last, it should be noted that the above embodiments are only used to illustrate the technical solution of the present disclosure, but not to limit it. Simple modifications or equivalent substitutions with respect to the various technical features of the embodiments all fall in the protection scope of the present disclosure.

What is claimed is:

1. An air pump device with an automatic air replenishing function, comprising:

a mounting housing, provided with an external air vent, configured to be arranged outside an inflatable product, and a valve port, configured to be connected to an inner cavity of the inflatable product;

an air duct, formed within the mounting housing and with both ends respectively communicated with the external air vent and the valve port;

a blower, provided within the mounting housing and configured to drive air within the air duct to flow;

a control system, provided within the mounting housing and configured to control various electrical parts within the air pump device;

an air replenishing pump, provided within the mounting housing and controlled by the control system; and an air pressure sensor, configured to collect air pressure data for the control system, wherein the control system is further configured to monitor an internal air pressure of the inflatable product through the air pressure sensor, and trigger, with a monitored value of air pressure being lower than a preset threshold, the air replenishing pump to output air for entering the inner cavity of the inflatable product, wherein the air replenishing pump is provided with an outer air inhaling port and an air ejector pipe;

the outer air inhaling port is communicated with the air duct within the mounting housing;

the mounting housing is provided thereon with an air replenishing box;

two opposite sides of the air replenishing box are respectively provided with an air ejector pipe interface and an air replenishing port, the air ejector pipe interface being hermetically butted with the air ejector pipe, and the air replenishing port being configured to communicate the inner cavity of the inflatable product outwards;

a plurality of silencing cotton chunks accommodated inside the air replenishing box are arranged between the air ejector pipe interface and the air replenishing port;

a transition cavity formed inside the air replenishing box is arranged between every two silencing cotton chunks;

the transition cavity is internally provided with a plurality of partition plates each provided thereon with an intermediate channel, and two adjacent intermediate channels are staggered from each other, and wherein the air replenishing pump inhales air through the outer air inhaling port, inputs an airflow into the air replenishing box through the air ejector pipe and the air ejector pipe interface, drives the airflow to sequentially pass through the silencing cotton chunks, and then outputs the airflow from the air replenishing port to the inner cavity of the inflatable product.

2. The air pump device according to claim 1, wherein an outer wall of the mounting housing is provided with a detection port configured to be communicated with the inner cavity of the inflatable product;

the mounting housing is internally provided inside with an air pressure collecting pipe;

one end of the air pressure collecting pipe is hermetically butted with the detection port, and the other end of the air pressure collecting pipe is hermetically butted with a detection end of the air pressure sensor, and wherein the detection end of the air pressure sensor is communicated with the inner cavity of the inflatable product through the air pressure collecting pipe.

3. The air pump device according to claim 1, wherein an air collecting cavity is formed between an inner side of the air replenishing box and one of the silencing cotton chunks, and the air collecting cavity has a smaller space than the transition cavity; and the air ejector pipe interface is connected into the air collecting cavity.

4. The air pump device according to claim 1, wherein one side of the air replenishing pump is provided with a support plate fixed within the mounting housing, and a damping block is elastically connected between the support plate and the air replenishing pump.

5. The air pump device according to claim 1, wherein the air replenishing pump includes a housing, two opposite ends of the housing are respectively provided with an outer air inhaling port and an air ejector pipe, and the housing is internally provided with an air replenishing motor, an eccentric wheel, a shifting lever, a shifting disc and a plurality of elastic airbags;

wherein an eccentric hole is obliquely provided in the eccentric wheel, and forms a certain included angle with a rotating central hole of the eccentric wheel;

a rotating shaft of the air replenishing motor is sleeved to the rotating central hole of the eccentric wheel;

one end of the shifting lever is inserted into the eccentric hole, and the other end of the shifting lever is inserted into a central hole of the shifting disc;

the plurality of elastic airbags are circumferentially arranged and surround the rotating central hole of the eccentric wheel; and an air outlet of each of the elastic airbags is communicated with the air ejector pipe, and wherein the shifting disc circumferentially oscillates with the rotation of the eccentric wheel, and the circumferentially oscillating shifting disc sequentially compresses the elastic airbags, which respectively resume expansion after a compressing force is removed.

6. The air pump device according to claim 5, wherein the housing is internally provided with an air outlet cover, an air replenishing seat, a front fixing seat and a rear fixing seat which are butted with each other sequentially;

the air ejector pipe is connected into an inner cavity of the air outlet cover;

the elastic airbags are each fixedly provided within the front fixing seat;

a plurality of vent holes are provided in the air replenishing seat and are respectively communicated with the inner cavity of the air outlet cover, and the air outlets of the elastic airbags are respectively butted with and communicated with the vent holes; and the housing of the air replenishing motor is fixedly butted with the rear fixing seat, and the eccentric wheel, the shifting lever and the shifting disc are respectively accommodated within the rear fixing seat.

7. The air pump device according to claim 6, further comprising a plurality of connecting grooves, which are circumferentially arranged and are integrally formed on an outer wall of the air outlet cover, the air replenishing seat, the front fixing seat and the rear fixing seat respectively;

both ends of each of the connecting grooves are respectively formed with a buckling position on the outer wall of the air outlet cover and the rear fixing seat; and a connecting rod is fittingly sleeved in each of the connecting grooves, and both ends of the connecting rod are respectively formed with a buckle, and the connecting rod is fixedly buckled to the buckling positions on the outer wall of the air outlet cover and the rear fixing seat through the buckles at both ends.

8. The air pump device according to claim 6, wherein a plurality of air ejector cavities and an annular cavity are defined within the inner cavity of the air outlet cover; the air outlet cover is further provided with an air ejector hole and an inner air inhaling port; the air ejector hole is located at the center of the air outlet cover and configured to be butted and communicated with the air ejector pipe, and the air ejector cavities each surround the air ejector hole and are all communicated with the air ejector hole; and the annular cavity surrounds the periphery of each of the air ejector cavities and is communicated with the inner air inhaling port.

9. The air pump device according to claim 8, wherein the rear fixing seat, the front fixing seat, the air replenishing seat and the air outlet cover are respectively communicated with the inner air inhaling port and the outer air inhaling port; the air replenishing seat is further provided with a plurality of circumferentially distributed first air inhaling through holes, each of which has one end communicated with the annular cavity, and the other end communicated with the inner cavity of the front fixing seat.

10. The air pump device according to claim 9, the front fixing seat is provided with a plurality of second air inhaling through holes, each of which has one end communicated with the inner cavity of the front fixing seat, and the other end butted and communicated with a respective one of the first air inhaling through holes, such that the first air inhaling through holes are communicated with the inner cavity of the front fixing seat; the elastic airbags are integrally formed on a substrate, the substrate is located between the air replenishing seat and the front fixing seat and is provided with a plurality of third air inhaling through holes, the front fixing seat is further provided with a plurality of fourth air inhaling through holes at positions corresponding to the third air inhaling through holes, each of the fourth air inhaling through holes has one end communicated with the inner cavity of the front fixing seat, and the other end butted and communicated with a respective one of the third air inhaling through holes; and a plurality of air replenishing grooves are integrally formed on the air replenishing seat, each of the air replenishing grooves has one end communicated with the air outlet of a respective one of the elastic airbags, and the other end communicated with a respective one of the third air inhaling through holes.

11. The air pump device according to claim 10, a central cavity is defined within each of the air ejector cavities, and each central cavity is hermetically butted and communicated with a respective one of the vent holes in the air replenishing seat; a multi-section tortuous channel is further defined within each of the air ejector cavities, the multi-section tortuous channel surrounds the periphery of the central cavity, and has one end communicated with the central cavity, and the other end communicated with the air ejector hole in the center of the air outlet cover.

12. A method for using the air pump device according to claim 1, comprising steps of inflating an inflatable product:

controlling, by the control system, to open the valve port of the air pump device;

further controlling the blower to rotate and pump in the external air from the external air vent of the air pump device into the air duct of the air pump device, and drive the air within the air duct into the inflatable product through the valve port;

detecting, by the air pressure sensor of the air pump device, the air pressure of the inner cavity of the inflatable product; and determining if the air pressure detected rises to a preset threshold, if yes, inactivating the blower and closing the valve port of the air pump device by the control system.

13. The method for using the air pump device according to claim 1, further comprising steps of increasing the air pressure of the inflatable product:

after the inflation is completed, monitoring, by the control system, the internal air pressure of the inflatable product continuously through the air pressure sensor;

determining that if the value of air pressure monitored by the air pressure sensor is lower than an additional preset threshold, if yes, starting, by the control system, the air replenishing pump of the air pump device to replenish air to the inner cavity of the inflatable product, until the air pressure sensor detected is up to the additional preset threshold, controlling, by the control system, the air replenishing pump to stop operating.

14. The method for using the air pump device according to claim 12, further comprising steps of deflating the inflatable product:

controlling, by the control system, to open the valve port of the air pump device, and further controlling the blower to rotate and continuously drive the air within the air duct of the air pump device to be exhausted to the outside through the external air vent, where the air duct of the air pump device forms a negative pressure and pumps out the air of the inner cavity of the inflatable product through the valve port;

detecting, by the air pressure sensor of the air pump device, the air pressure of the inner cavity of the inflatable product; and determining that if the value of air pressure detected by the air pressure sensor drops to another preset threshold, if yes, inactivating the blower and closing the valve port of the air pump device controlled by the control system.

15. The method for using the air pump device according to claim 12, further comprising steps of decreasing the air pressure in the inflatable product:

controlling, by the control system, to open the valve port, so that the air of the inner cavity of the inflatable product naturally enters the air duct of the air pump device and is exhausted to the outside through the external air vent;

detecting, by the air pressure sensor of the air pump device, the air pressure of the inner cavity of the inflatable product; and determining that if the air pressure detected is equal to or lower than an additional preset threshold, if the air pressure detected is equal to the additional preset threshold, controlling, by the control system, to close the valve port of the air pump device; and if the air pressure detected is lower than the additional preset threshold, starting, by the control system, the air replenishing pump of the air pump device to replenish air to the inner cavity of the inflatable product, until the air pressure detected is up to the additional preset threshold, controlling, by the control system, the air replenishing pump to stop operating.

* * * * *